US012796790B2

(12) United States Patent
Hoodecheck et al.

(10) Patent No.: US 12,796,790 B2
(45) Date of Patent: Nov. 17, 2026

(54) ADJUSTABLE GRIP SYSTEM FOR TREKKING POLES AND THE LIKE

(71) Applicant: Hoodco, Inc., Lone Tree, CO (US)

(72) Inventors: Stephen C. Hoodecheck, Lone Tree, CO (US); Scott Noble, Denver, CO (US); Robert M. Miller, Golden, CO (US)

(73) Assignee: Hoodco, Inc., Lone Tree, CO (US)

( * ) Notice: Subject to any disclaimer, the term of this patent is extended or adjusted under 35 U.S.C. 154(b) by 251 days.

(21) Appl. No.: 18/584,982

(22) Filed: Feb. 22, 2024

(65) Prior Publication Data

US 2024/0188695 A1 Jun. 13, 2024

Related U.S. Application Data

(63) Continuation-in-part of application No. 17/729,571, filed on Apr. 26, 2022, now Pat. No. 11,957,223.

(60) Provisional application No. 63/246,947, filed on Sep. 22, 2021.

(51) Int. Cl.

| | |
|---|---|
| ***A45B 9/02*** | (2006.01) |
| ***A63C 11/22*** | (2006.01) |
| *A45B 9/00* | (2006.01) |

(52) U.S. Cl.

CPC ..... *A45B 9/02* (2013.01); *A63C 11/222* (2013.01); *A45B 2009/005* (2013.01); *A45B 2200/055* (2013.01)

(58) Field of Classification Search

CPC ..... A45B 9/02; A45B 2009/005; A45B 2200/055; A63C 11/222

USPC ..... 135/72; 280/821

See application file for complete search history.

(56) References Cited

U.S. PATENT DOCUMENTS

| | | | | |
|---|---|---|---|---|
| 4,061,347 | A * | 12/1977 | Stern | A63C 11/222 280/821 |
| 4,448,442 | A | 5/1984 | Weber-henning et al. | |
| 4,597,589 | A | 7/1986 | Fujii et al. | |
| 5,114,186 | A * | 5/1992 | Sugiyama | A63C 11/221 280/821 |
| 5,287,870 | A | 2/1994 | Rhodes | |
| 5,441,307 | A | 8/1995 | Quintana et al. | |
| 6,070,907 | A | 6/2000 | Bujold et al. | |
| 6,082,767 | A * | 7/2000 | Bujold | A63C 11/22 135/84 |
| 6,142,527 | A | 11/2000 | Lenhart | |

(Continued)

FOREIGN PATENT DOCUMENTS

| | | |
|---|---|---|
| DE | 8702756 U1 | 4/1987 |
| DE | 4440343 A1 | 5/1996 |

(Continued)

OTHER PUBLICATIONS

Notice of Allowance received for U.S. Appl. No. 17/729,571, mailed on Nov. 22, 2023, 10 pages.

*Primary Examiner* — Robert Canfield
(74) *Attorney, Agent, or Firm* — David C. Eyvazzadeh

(57) ABSTRACT

An adjustable grip system configured for attachment to a pole which is intended for recreational or ambulatory use. The adjustable grip system provides adjustability of a grip in relation to longitudinal axis wherein the grip is adjustable in up to 3-degrees of freedom in relation to the pole portion and affixable in place once adjusted to the desired configuration.

14 Claims, 22 Drawing Sheets

(56) References Cited

U.S. PATENT DOCUMENTS

| | | | | |
|---|---|---|---|---|
| 6,203,063 | B1 * | 3/2001 | Bujold | A63C 11/22 403/57 |
| 6,491,323 | B1 | 12/2002 | Kustritz | |
| 6,644,328 | B1 * | 11/2003 | Lenhart | A63C 11/222 52/72 |
| 6,755,440 | B1 | 6/2004 | Jones | |
| 8,496,018 | B2 | 7/2013 | Lenhart et al. | |
| 8,579,329 | B2 * | 11/2013 | Lenhart | A63C 11/2224 280/821 |
| 10,722,010 | B2 | 7/2020 | D'jay | |
| 11,957,223 | B2 * | 4/2024 | Hoodecheck | A63C 11/222 |
| 12,514,348 | B2 * | 1/2026 | Liu | A45B 9/02 |
| 2010/0154850 | A1 | 6/2010 | Schulz et al. | |
| 2012/0015785 | A1 | 1/2012 | Burroughs | |
| 2016/0310827 | A1 | 10/2016 | Spataro et al. | |
| 2016/0316869 | A1 | 11/2016 | Byrd et al. | |
| 2023/0090070 | A1 | 3/2023 | Hoodecheck et al. | |

FOREIGN PATENT DOCUMENTS

| | | | |
|---|---|---|---|
| JP | H06-246030 | A | 9/1994 |
| KR | 10-2002-0036449 | A | 5/2002 |

* cited by examiner

SECTION G-G

SECTION I-I

SECTION J-J

ADJUSTABLE GRIP SYSTEM FOR TREKKING POLES AND THE LIKE

CROSS-REFERENCE TO RELATED APPLICATIONS

This application is a Continuation In-Part of U.S. patent application Ser. No. 17/729,571 entitled "Adjustable Grip System for Trekking Poles and the Like" filed on Apr. 26, 2022, which claims the benefit of U.S. Provisional Patent Application No. 63/246,947 entitled "Adjustable Grip System for Trekking Poles and the Like" filed on Sep. 22, 2021, the entire contents of which are incorporated herein by reference in its entirety for all purposes.

FIELD OF THE INVENTION

An adjustable grip system configured for attachment to a pole, and is intended for recreational or ambulatory use providing adjustability of a grip in relation to longitudinal axis wherein the grip is adjustable in up to 3-degrees of freedom in relation to the pole portion and affixable in place once adjusted to the desired configuration.

BACKGROUND OF THE INVENTION

The use of recreational poles, such as ski poles or trekking poles, span a number of activities such as skiing, hiking, and snowshoeing. In skiing for instance, the pole is a quintessential portion of the skiers gear and is instrumental to the balance and performance of a skier. In hiking and snowshoeing, poles are more-so seen as an optional piece of gear which while not required—can provide users with increased balance and control, and decreased fatigue and chance of injury.

Poles are typically sold for one intended purpose such as for skiing or for hiking/trekking. However, most poles consist of simply a shaft sized in relation to the height of the user, with a handgrip interconnected to a first end of the pole, and a ground interfacing element interconnected to the second end of the pole.

Some poles provide an adjustable overall length to accommodate different activities and different height users, however the rapid adjustability of orientation of the handle is not accounted for.

SUMMARY OF THE INVENTION

It is an aspect of the present disclosure to provide a rapid adjustability of the orientation of the grip in relation to the pole. In certain embodiments a ball and socket joint which allows adjustability of the grip in relation to the axis of the pole of angles up to 90 degrees from the longitudinal axis, allowing a user to use the trekking pole in a variety of uses including skiing, walking, snowshoeing. The adjustable grip system of the present disclosure further allows for the use of a trekking pole in a configuration resembling a cane or crutch as needed for walking comfort or in emergency scenarios.

In the event that the user wishes to use the adjustable grip system in a cane configuration, the user adjusts the grip to a desired angle (e.g., 90-degrees) from the pole by adjusting joint between a first portion and a second portion, and optionally adjusts the height of the pole as desired. In the event that the user wishes to use the adjustable grip system in a crutch configuration, the user adjusts the grip to a desired angle (e.g., 90-degrees) as performed for a cane operation, and optionally adjusts the height of the pole as desired such that the grip height is configured to be in the underarm region of the user when the distal end, opposite the grip, of the pole is resting on the ground. Furthermore, when using in a crutch configuration, a user optionally interconnects a second grip to the pole wherein the second grip is configured for a user to grasp with their hand when the first grip is placed under their arm. In one or more embodiments the second grip is configured to be foldable against the shaft of the trekking pole wherein the second grip is optionally unfolded to configure as a cane and/or crutch, and folded in a manner which minimizes the profile of the second grip when in a folded configuration. For instance the second grip comprises a portion of a cylindrical shell (e.g., a half-cylinder) including a concave portion configured to receive the shaft of the pole therein. In one or more embodiments of the present disclosure a grip is interconnectable (e.g., with threaded fastener) to the top of an adjustable grip system wherein the grip is configured to interconnect to the top of the adjustable grip system at one or more angles from the axis of the shaft of the pole. In one or more embodiments, the grip is optionally configured to be removably interconnected to the top of the adjustable grip system, wherein the grip is optionally disconnected from the top of the adjustable grip system, and optionally interconnected to the adjustable grip system at an angle (e.g., 90-degrees) from the axis of the pole. In one or more embodiments of the present disclosure the grip is optionally disconnected from the adjustable grip system and interconnected to the pole at an angle (e.g., 90-degrees) to configure the adjustable grip system in a cane and/or crutch configuration.

In certain embodiments, the ball and socket joint of certain embodiments comprises an angle guide which provides mechanical stops angularly displaced from the longitudinal axis to allow a user to rapidly position the grip of the pole to a predetermined angle of their choosing. For instance, an opening of certain embodiments comprises channels which provide mechanical stops at preset angles such as 10 degrees, 20 degrees, and 30 degrees, and 90 degrees from the longitudinal axis.

It is an aspect of the present disclosure to maximize adjustability of a grip in relation to a longitudinal axis. In certain embodiments, the adjustability of the grip in relation to a longitudinal axis is accomplished through the use of a ball and socket joint which provides up to 3 degrees of freedom of adjustability.

It is an aspect of the present disclosure to prevent movement of the grip once adjusted to a desired angle from the longitudinal axis of the pole to which it is attached. In certain embodiments, gripping mechanisms are augmented for increased grip through the use of elements such as frictional holds, pin detents in the socket aspect which interface with dimples, or facets in the external aspect of the spheroid shape which are configured to engage with features within the socket portion of the ball and socket joint.

Certain embodiments of the present disclosure disclosed herein surround an adjustable grip system for interconnection with a pole or shaft, such as a trekking pole, to allow a user to adjust the position of the grip in relation to the pole to a desired and/or optimal configuration for the intended use. In certain embodiments, a user is able to make such adjustments without the use of tools. In certain embodiments a user is able to adjustably reconfigure the grip in relation to the pole in at least 3 degrees of freedom corresponding to rotational movement around the x, y, and z axes.

It will be appreciated that a typical trekking pole comprises a linear shaft which is intended to be used vertically, and while a grip may have an intended manner in which a user should grasp the grip, the rotation of the shaft of the pole is inconsequential to its functionality.

In certain embodiments, the adjustable grip system incorporates a pinned joint about an axis which is typically horizontal when the trekking pole is held in a vertical manner for the pitch of the handle forward and backward, and the grip allows for axial adjustability rotating about the longitudinal axis of the grip. Due to the uniaxial nature of the pole shaft being able to be used in any configuration, the adjustment of the forward pitch of the grip, and the axial rotation of the grip results in the ability to adjust the grip configuration of the system in 3-degrees of freedom through the rotation about 2 axes. It is an aspect of the present disclosure to provide 3 degrees or more of adjustability through the adjustable rotation of the grip about 2 axes of rotation.

It is a further aspect of the present disclosure that the adjustable grip system of the present disclosure is configured to interconnect with poles having differing diameters.

It is an aspect of certain embodiments to provide three degrees of freedom of adjustability wherein a first portion and a second portion are interconnected at a joint which provides articulating rotation about a first axis. A grip is interconnected to a third portion which is slidably interconnected to the second portion about a second axis, such that the rotational position of the grip is adjustable in relation to the second portion.

In certain embodiments of the present disclosure, a joint interconnects a first portion and a second portion of an adjustable grip system wherein the joint in a normal state is in locked configuration constraining the rotation of the second portion in relation to the first portion. Upon disengaging a first locking mechanism, the joint is able to move freely and allows the rotational motion of the second portion in relation to the first portion.

These and other advantages will be apparent from the disclosure of the present disclosure contained herein. The above-described embodiments, objectives, and configurations are neither complete nor exhaustive. As will be appreciated, other embodiments of the present disclosure are possible using, alone or in combination, one or more of the features set forth above or described in detail below. Further, this Summary is neither intended nor should it be construed as being representative of the full extent and scope of the present disclosure. The examples described in present disclosure are set forth in various levels of detail in this Summary, as well as in the attached drawings and the detailed description below, and no limitation as to the scope of the present disclosure is intended to either the inclusion or non-inclusion of elements, components, etc. in this Summary. Additional aspects of the present disclosure will become more readily apparent from the detailed description, particularly when taken together with the drawings, and the claims provided herein.

BRIEF DESCRIPTION OF THE DRAWINGS

FIG. 1B—A front view of certain embodiments of the present disclosure

FIG. 1C—A side section view of the embodiments of the present disclosure shown in FIG. 1B FIG. 2—A bottom view of certain embodiments of the present disclosure FIG. 3A—A front view of certain embodiments of the present disclosure FIG. 3B—A side section view of certain embodiments of the present disclosure shown in FIG. 3A FIG. 4A—A front view of certain embodiments of the present disclosure FIG. 4B—A side section view of certain embodiments of the present disclosure shown in FIG. 4A FIG. 5—An exploded perspective view of certain embodiments of the present disclosure FIG. 6—An exploded perspective view of certain embodiments of the present disclosure FIG. 7—A top view of certain embodiments of the present disclosure FIG. 8A—A side view of certain embodiments of the present disclosure FIG. 8B—A perspective view of certain embodiments of the present disclosure FIG. 8C—A top view of certain embodiments of the present disclosure FIG. 9A—A perspective view of certain embodiments of the present disclosure FIG. 9B—A perspective view of certain embodiments of the present disclosure FIG. 10A—A side view of certain embodiments of the present disclosure FIG. 10B—A front view of certain embodiments of the present disclosure FIG. 11A—A side view of certain embodiments of the present disclosure FIG. 11B—A front view of certain embodiments of the present disclosure FIG. 11C—A side section-view of certain embodiments of the present disclosure as shown in FIG. 11B FIG. 12A—An exploded perspective view of certain embodiments of the present disclosure FIG. 12B—An exploded perspective view of certain embodiments of the present disclosure FIG. 13A—An exploded perspective view of certain embodiments of the present disclosure FIG. 13B—A side view of certain embodiments of the present disclosure FIG. 13C—A front section-view of certain embodiments of the present disclosure as shown in FIG. 13B with a first locking mechanism in a locked configuration FIG. 13D—A front section-view of certain embodiments of the present disclosure as shown in FIG. 13B with a first locking mechanism in an unlocked configuration FIG. 14A—A front view of certain embodiments of the present disclosure with a second locking mechanism in an unlocked configuration FIG. 14B—A side section-view of certain embodiments of the present disclosure as shown in FIG. 14A FIG. 14C—A perspective view of certain embodiments of the present disclosure with a second locking mechanism in an unlocked configuration FIG. 14D—A perspective view of certain embodiments of the present disclosure with a second locking mechanism in an unlocked configuration FIG. 14E—A perspective view of certain embodiments of the present disclosure with a second locking mechanism in a locked configuration FIG. 14F—A side section-view of certain embodiments of the present disclosure as shown in FIG. 14E FIG. 15A—A perspective view of certain embodiments of the present disclosure FIG. 15B—An exploded perspective view of certain embodiments of the present disclosure FIG. 15C—A side view of certain embodiments of the present disclosure FIG. 15D—A cross-sectional view the embodiment shown in FIG. 15C FIG. 16A—A perspective view of certain embodiments of the present disclosure FIG. 16B—An exploded perspective view of certain embodiments of the present disclosure FIG. 16C—A side view of certain embodiments of the present disclosure FIG. 16D—A cross-sectional view the embodiment shown in FIG. 16C FIG. 16E—A cross-sectional view the embodiment shown in FIG. 16C FIG. 16F—A perspective view of certain embodiments of the present disclosure FIG. 16G—An exploded perspective view of certain embodiments of the present disclosure FIG. 17A—FIG. 17F—Multiple perspective views of certain embodiments comprises a keyed pin for engagement with the joint.

DETAILED DESCRIPTION OF VARIOUS EMBODIMENTS

Figure 1A:
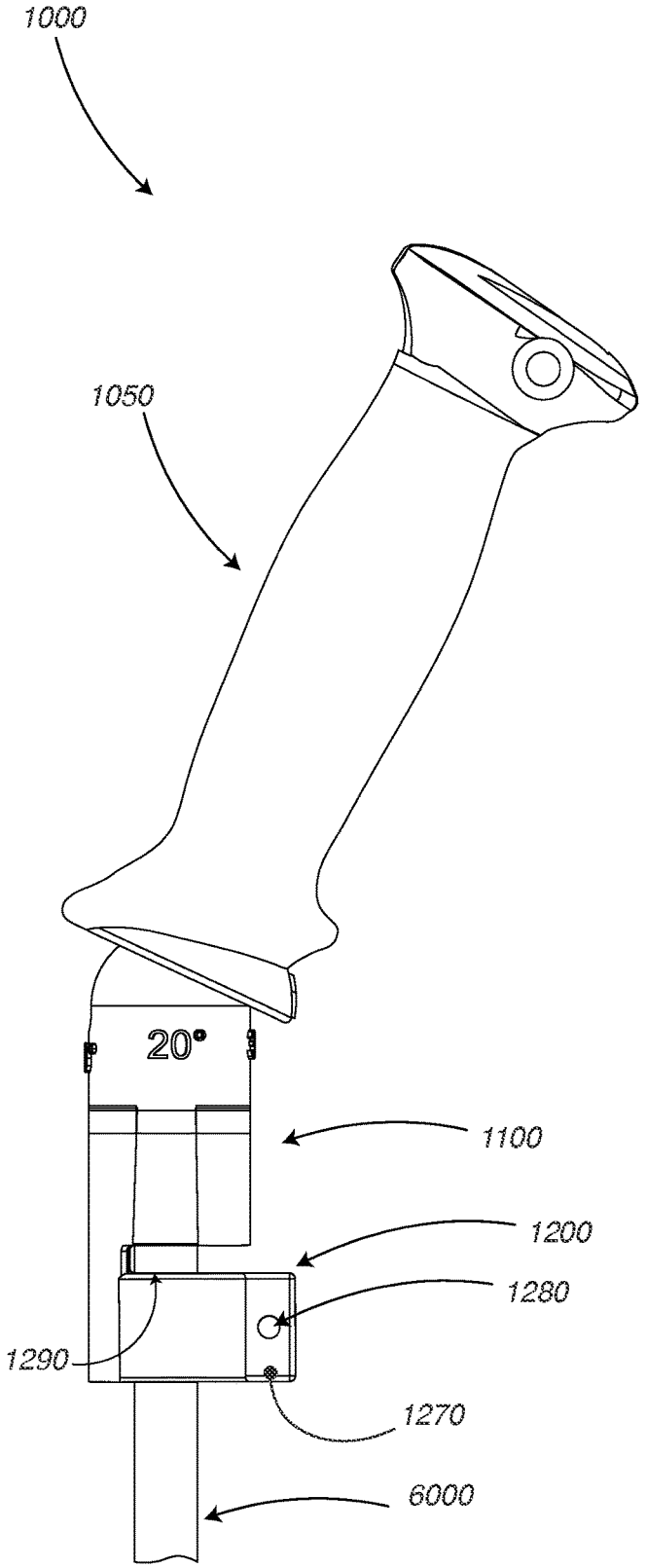
FIG. 1A—A side view of certain embodiments of the present disclosure
Figure 1B:
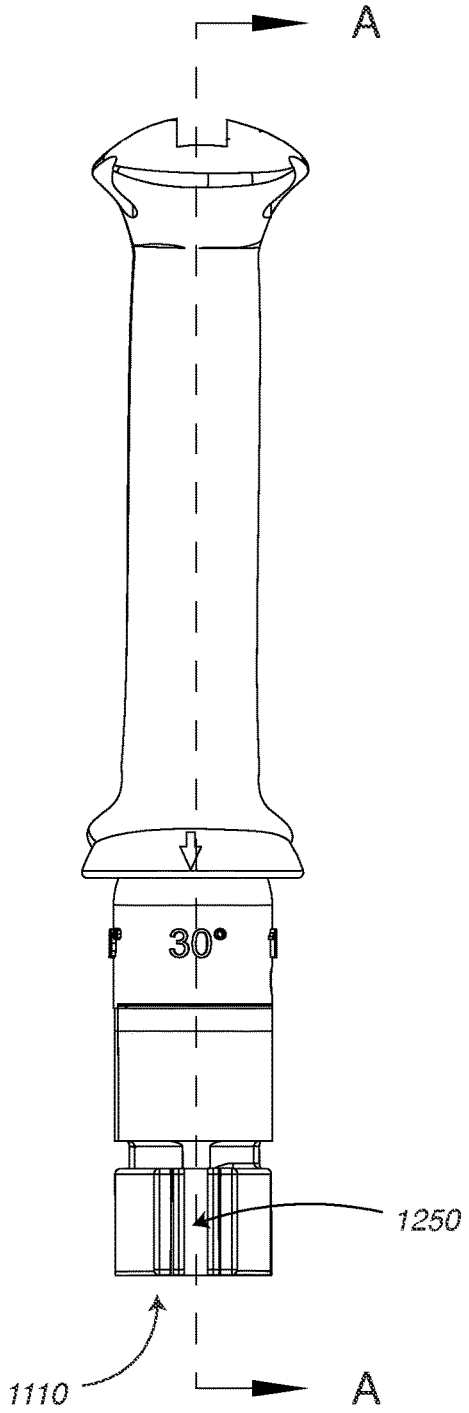
Figure 1C:
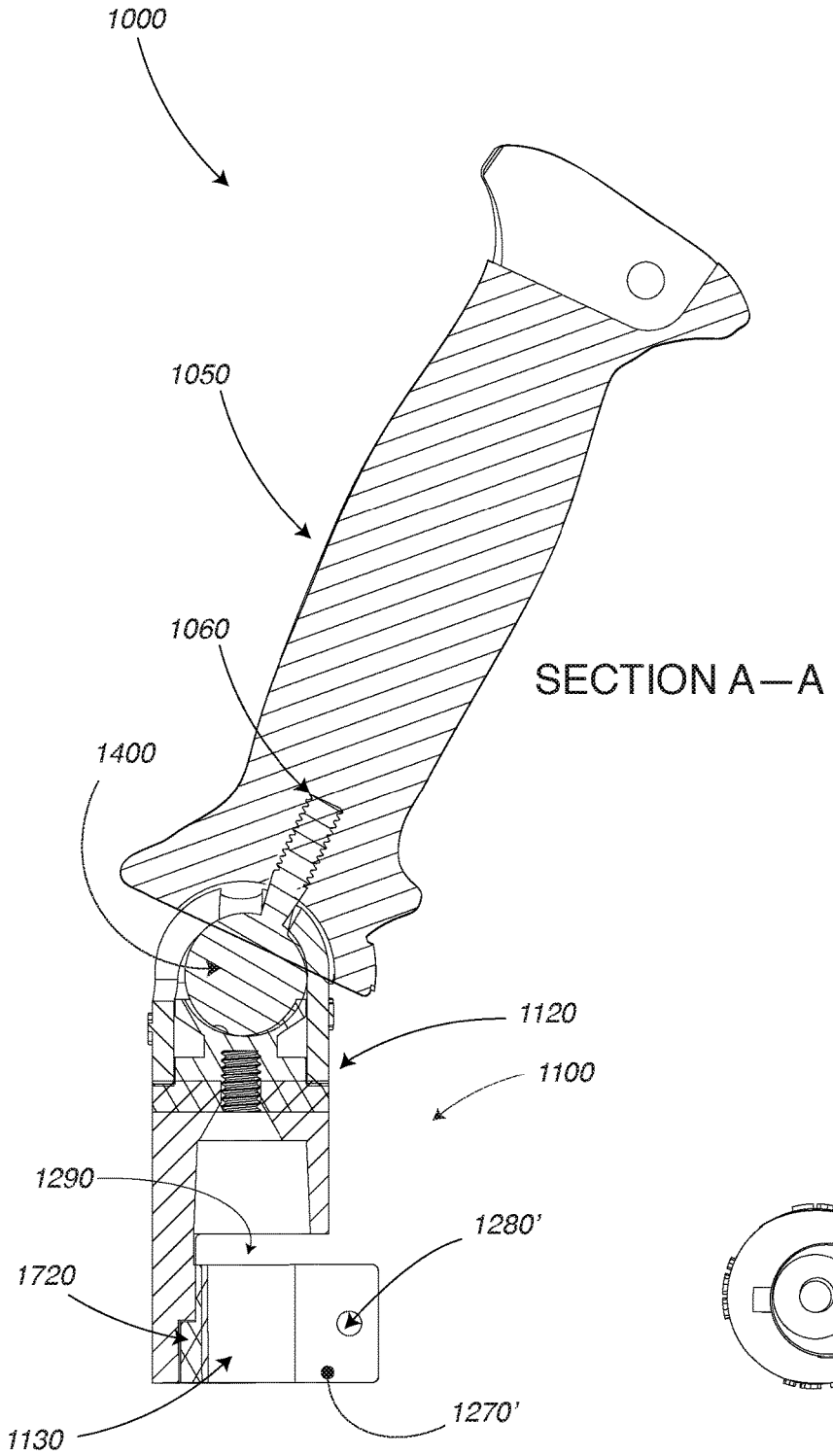
Figure 2:
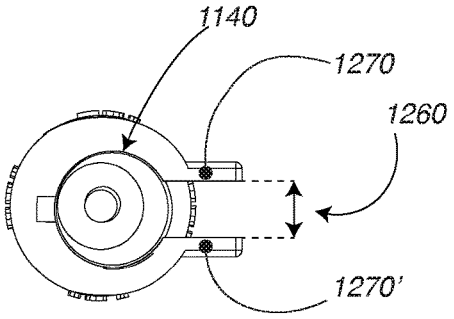
Figure 3A:
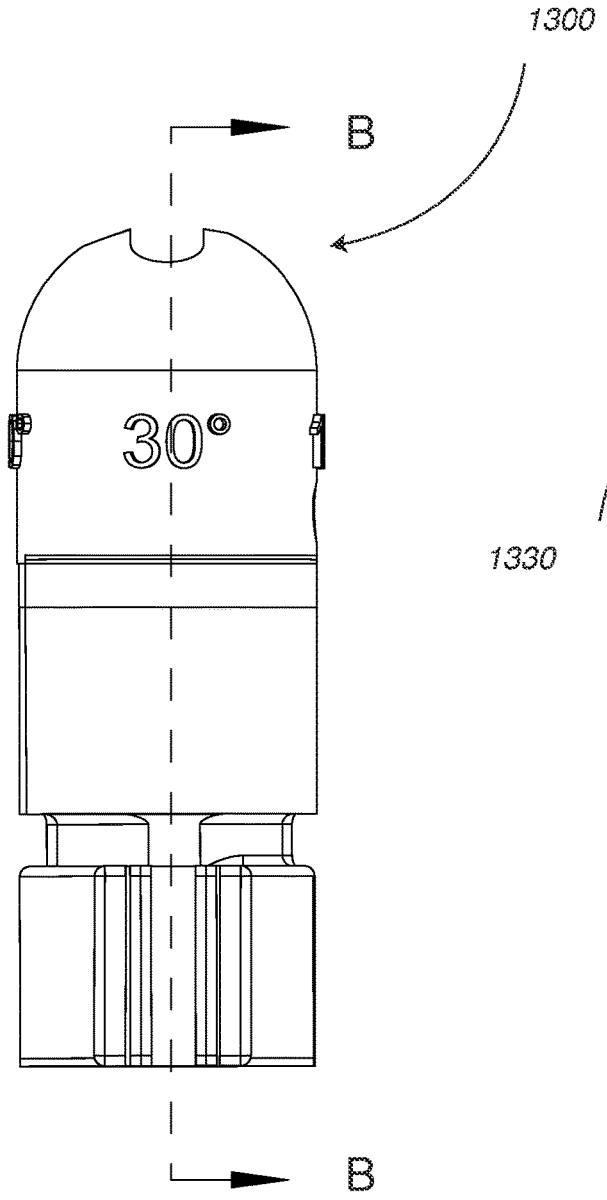
Figure 3B:
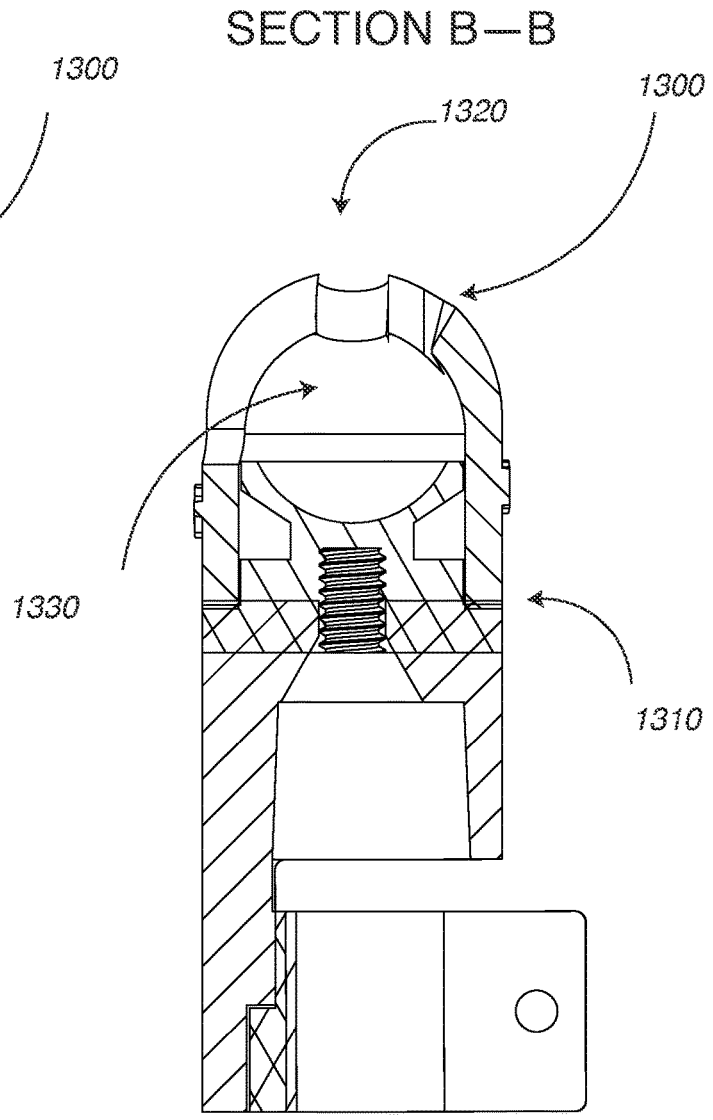

Certain embodiments of the present disclosure disclosed herein, shown in FIG. 1A—FIG. 2, comprise an adjustable grip system 1000 which permits the adjustability of a grip 1050 attached thereto. Comprising a sleeve 1100 configured to interconnect with a shaft (e.g., pole 6000) of a pole. The sleeve 1100 comprises a hollow aspect 1130 having a cylindrical form wherein the shaft of the pole 6000 can be inserted therein to interconnect with the sleeve 1100 by inserting the pole 6000 into the first end 1110 of the sleeve. The sleeve further comprises a clamp 1200 interconnected with a first end of the sleeve, wherein the clamp 1200 is configured to constrict the hollow aspect 1130 of the sleeve radially inward, thereby constraining the pole 6000 within the sleeve. In certain embodiments the clamp 1200 is interconnected to the first end 1110 of the sleeve and the sleeve comprises a longitudinal split 1250 having a width 1260 which extends the longitudinal length 1210 of the clamp. The longitudinal split 1250 allows the constriction of the clamp 1200.

In certain embodiments comprising a clamp 1200, the clamp further comprises a first tab 1270 and a second tab 1270' interconnected to the clamp on either side of the longitudinal split 1250. Drawing the tabs together, reduces the width 1260 of the longitudinal split 1250 of the clamp and constricts the clamp inward to affix it to a pole 6000. As shown, the tabs comprise coaligned apertures 1280, 1280' which allow for the insertion of threaded hardware or other mechanical fasteners to further enable the drawing of the first tab 1270 toward the second tab 1270'. It will be appreciated that the clamp interconnected to the first end of the sleeve can be constricted through a number of strategies known to those skilled in the art including draw latches, and threaded hardware.

In certain embodiments, referencing FIG. 1A—FIG. 2, wherein a sleeve comprises a clamp 1200, the clamp 1200 is integral to the sleeve 1100 wherein the clamp 1200 is able to constrict without constricting the sleeve 1100. Lateral relief cuts 1290 around a portion of the circumference 1140 of the sleeve allow the clamp 1200 to constrict independently of the sleeve 1100 while interconnected to the sleeve.

Figure 4A:
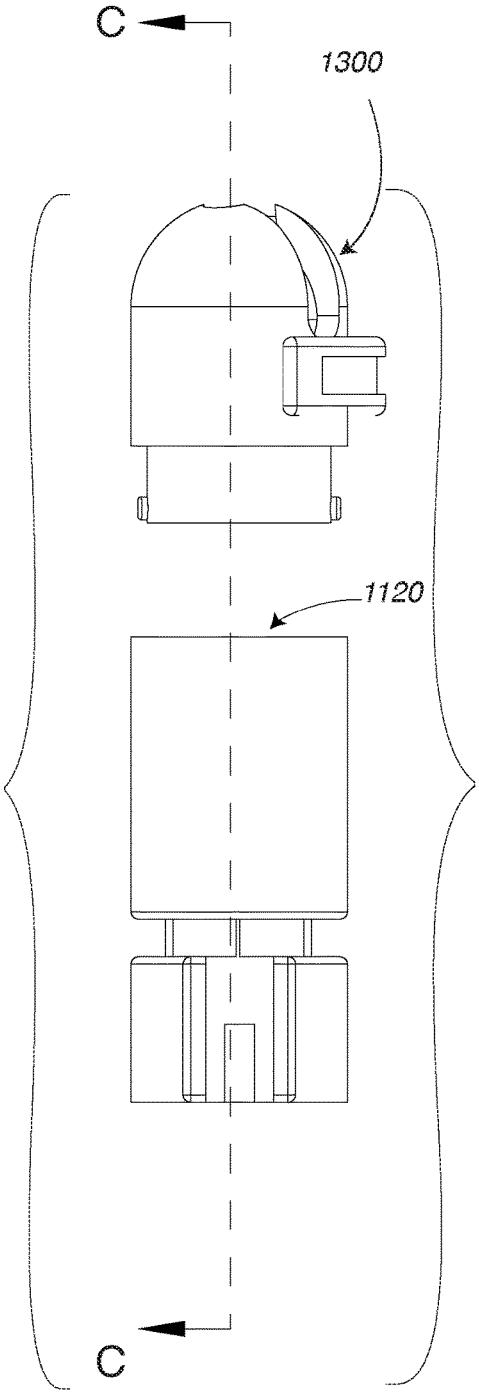
Figure 4B:
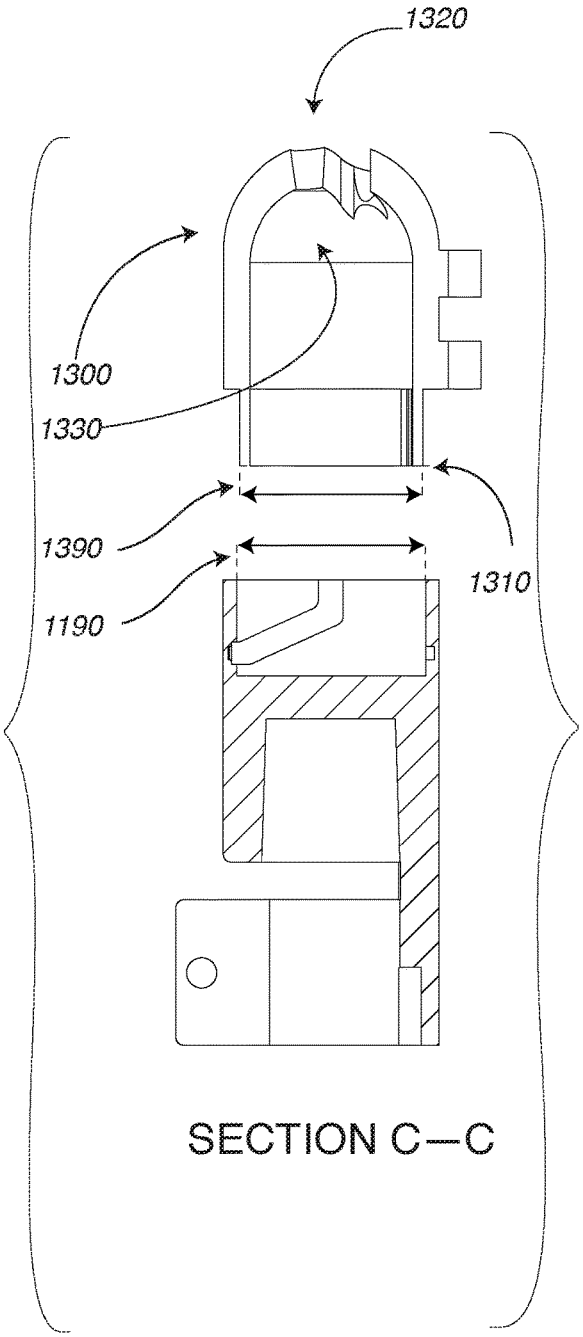

Certain embodiments, shown in FIG. 3A—FIG. 4B comprise a cap 1300 having a hollow aspect wherein the cap 1300 comprises a cylindrical first end 1310 configured to interconnect with the cylindrical second end 1120 of the sleeve, and a second end 1320 comprising a hemispherically shaped internal surface 1330 wherein the second end 1320 is configured to receive a spheroid 1400 (FIG. 1C) therein. The cap 1300 of certain embodiments, such as shown in FIG. 4A-4B, is configured to be releasably interconnectable to the sleeve.

Figure 5:
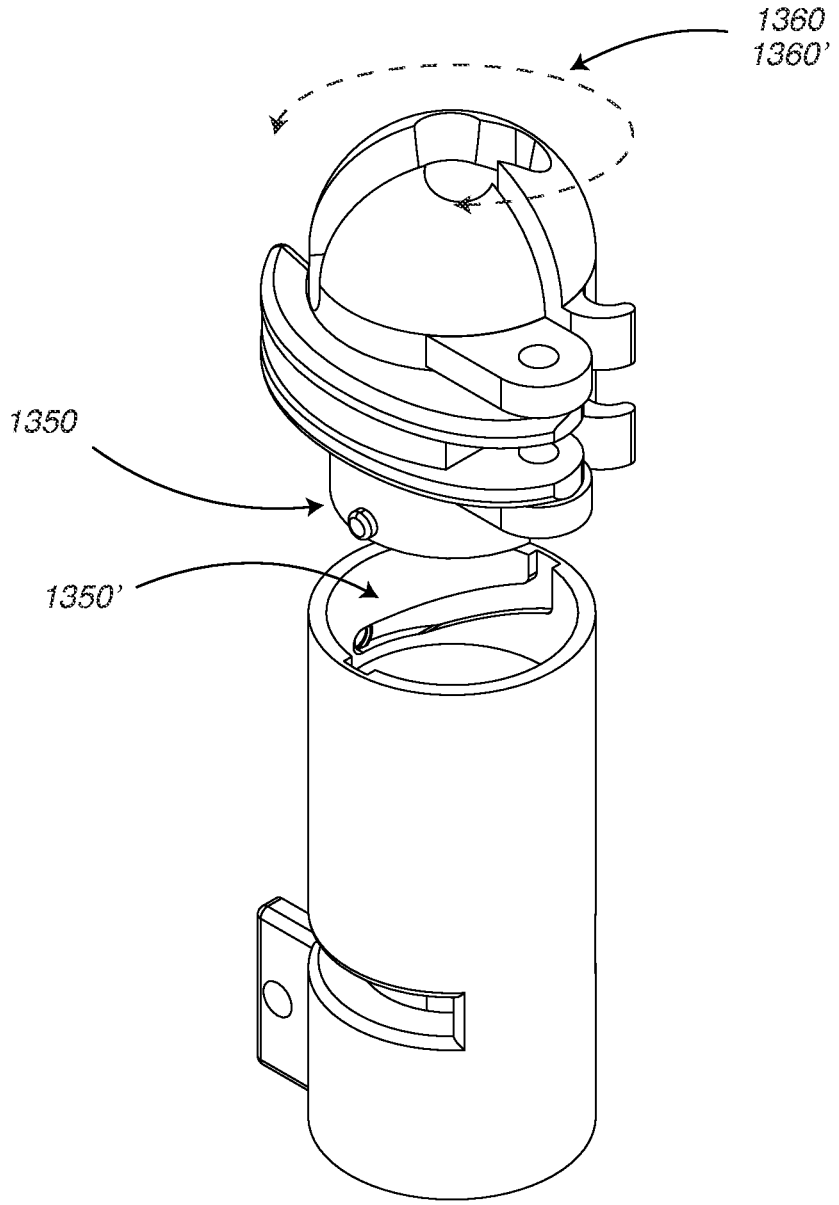

As shown in FIG. 4A—FIG. 5, the cylindrical first end 1310 of the cap has an external diameter 1390 less than then the internal diameter 1190 of the cylindrical second end of the sleeve wherein the first end of the cap is configured to insert within the second end of the sleeve. In certain embodiments, the cap is interconnected to the sleeve using a bayonet mount 1350, 1350' wherein twisting 1360 of the cap 1300 in a first direction relation to the sleeve 1100 locks the cap to the sleeve, and twisting 1360' of the cap 1300 in a second direction, opposite to the first direction, unlocks the cap 1300 from the sleeve 1100.

In certain embodiments, such as shown FIG. 6A—FIG. 6B, in a cap 1300 is configured to receive a spheroid 1400 which comprises a stud 1410 which extends radially outward from the spheroid. The stud 1410 comprises threading 1420 wherein a grip 1050 can be attached thereto. The stud 1410 extends out from an opening 1500 in the second end of the cap 1320 such that a female threaded feature 1060 (FIG. 1C) of the grip can be interconnected to the spheroid 1400 using the stud 1410. It will be appreciated that while embodiments shown comprise a threaded stud, alternative attachment methods of interconnecting a grip with the spheroid are within the spirit and scope of the present disclosure. These alternative connections include, but are not limited to a female threaded hole within the spheroid wherein the grip comprises a male threaded stud configured to mate with the female threaded feature, pinned connections, or other connections appreciated by one skilled in the art.

Figure 6:
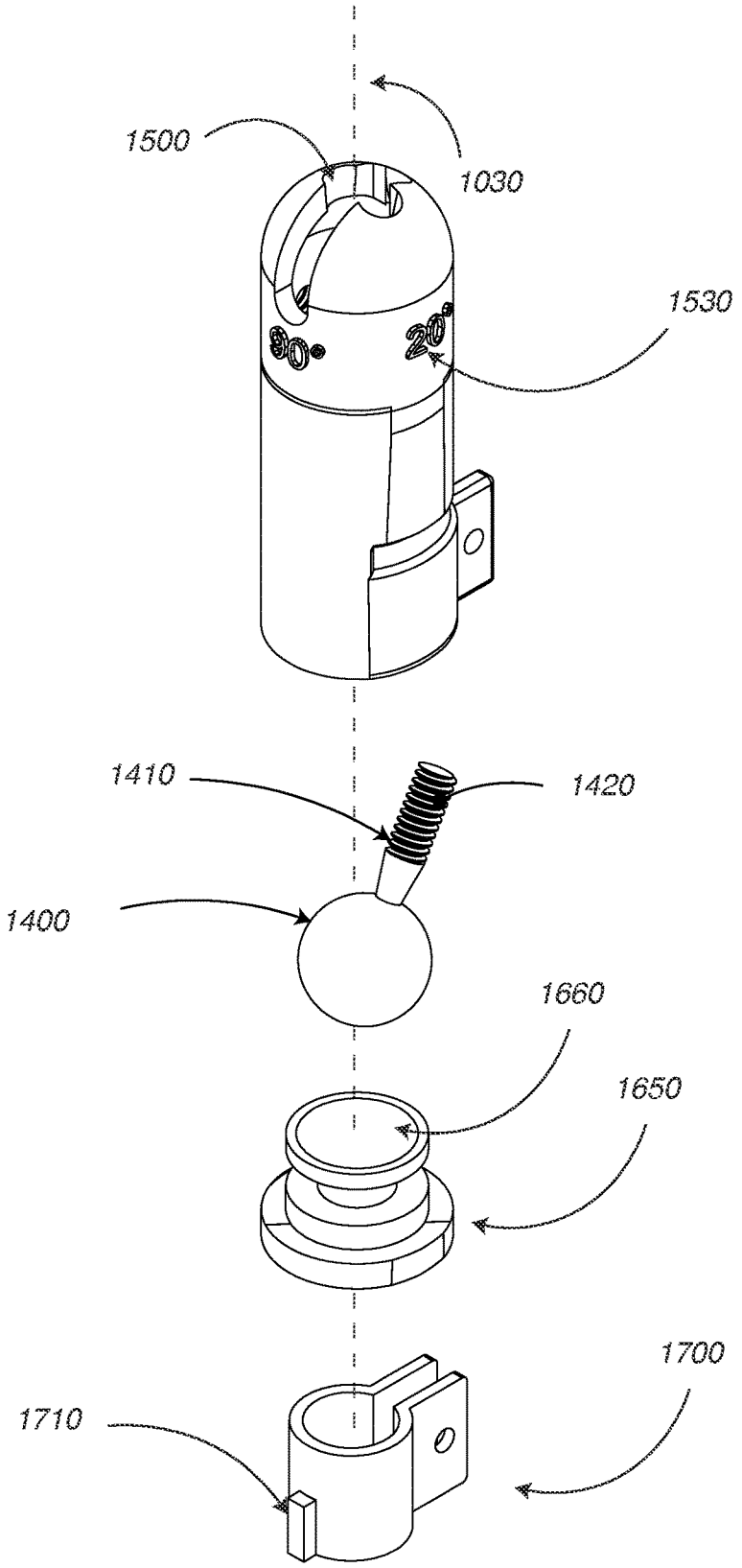
Figure 7:
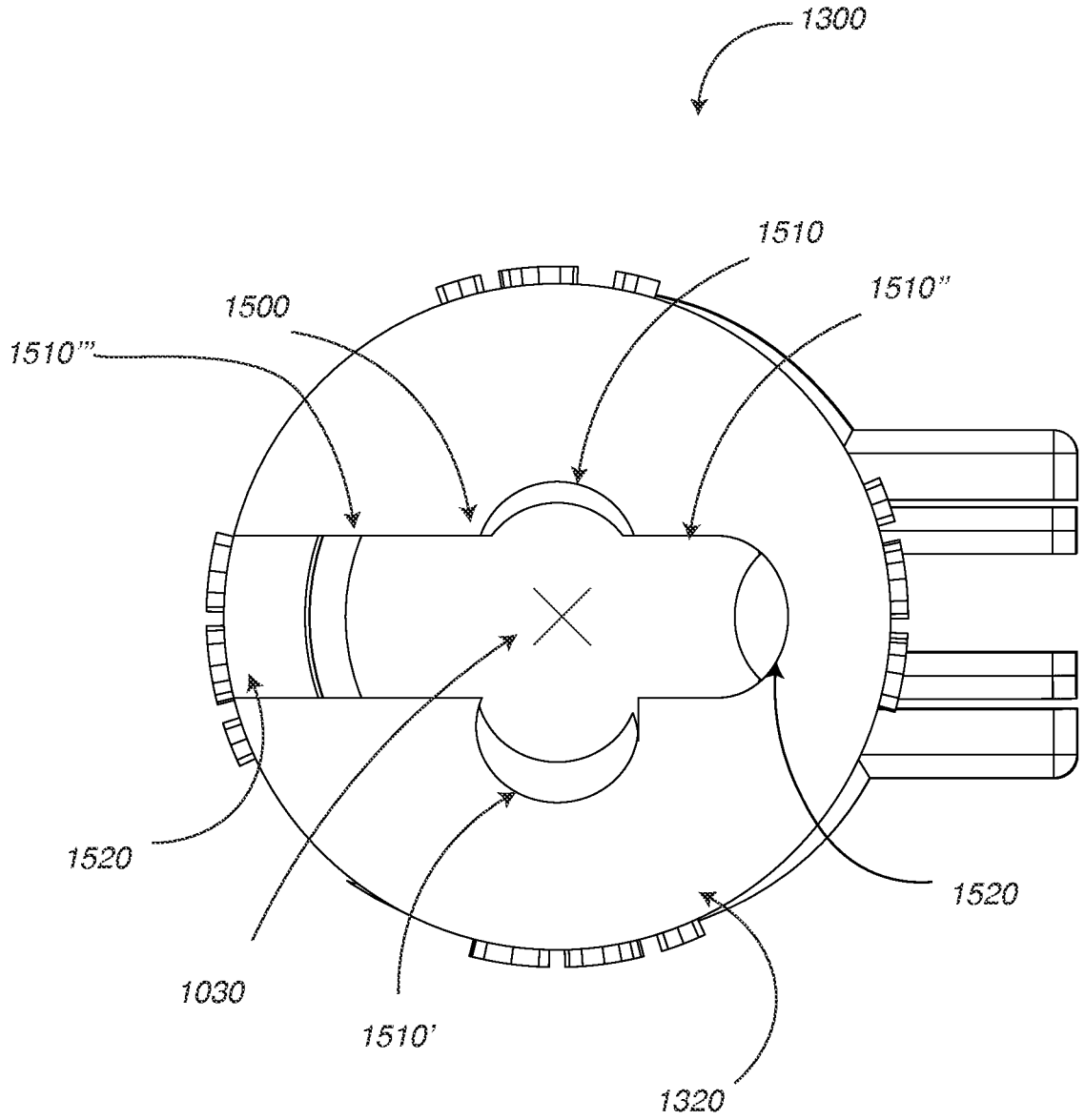

In certain embodiments, shown in FIG. 6-FIG. 7, the cap comprises a second end 1320 having an opening 1500 extending through the second end of the cap. The opening 1500 coincides with the longitudinal axis 1030 and comprises at least one channel 1510 which extends angularly away from the longitudinal axis 1030. The channel 1510 is configured such that the distal end 1520 of the channel is provides a mechanical stop for the stud 1410 of the spheroid. The mechanical stop is configured to dispose the stud 1410 at a predetermined angle, thereby disposing the grip attached thereto at the predetermined angle from the longitudinal axis 1030. In certain embodiments, an opening comprises a plurality of channels such as shown in FIG. 7 wherein the channels are angularly offset from each other. As shown the channels are angularly offset at 90 degrees from each other, however embodiments of the present disclosure are not limited thereto. In the example as shown in FIG. 7, the opening 1500 comprises four channels 1510 extending angularly outward wherein the channels 1510 are orthogonal to each other extending away from the longitudinal axis 1030. In certain embodiments a first channel 1510 provides a mechanical stop at 10 degrees from the longitudinal axis 1030, a second channel 1510' provides a mechanical stop at 20 degrees from the longitudinal axis, a third channel 1510" provides a mechanical stop at 30 degrees from the longitudinal axis, and a fourth channel 1510'" provides a mechanical stop at 90 degrees from the longitudinal axis. Although embodiments disclosed herein disclose mechanical stop angles of 10 degrees, 20 degrees, 30 degrees, and 90 degrees, embodiments comprising mechanical stops at alternate angles are within the spirit and scope of the present disclosure. In certain embodiments, referencing FIG. 6, the angle of mechanical stop provided by a channel is designated visibly 1530 on the external surface of the cap 1300.

Figure 8A:
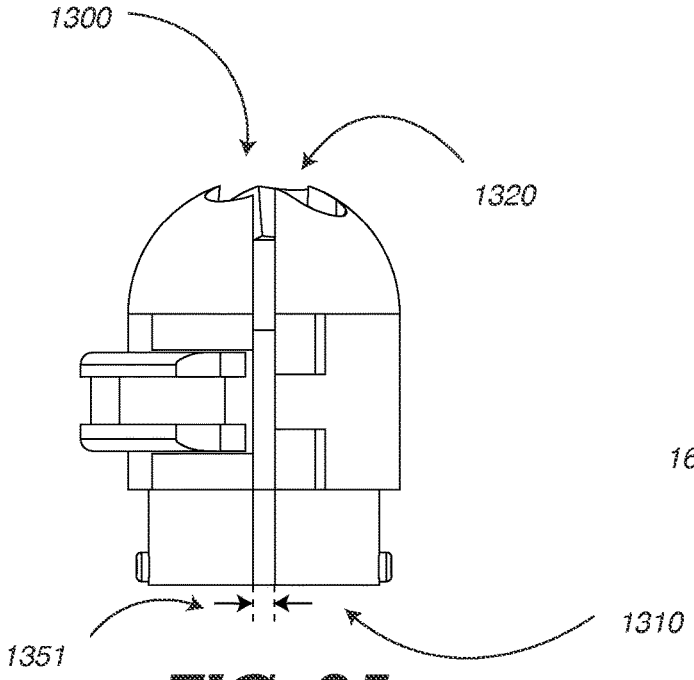
Figure 8B:
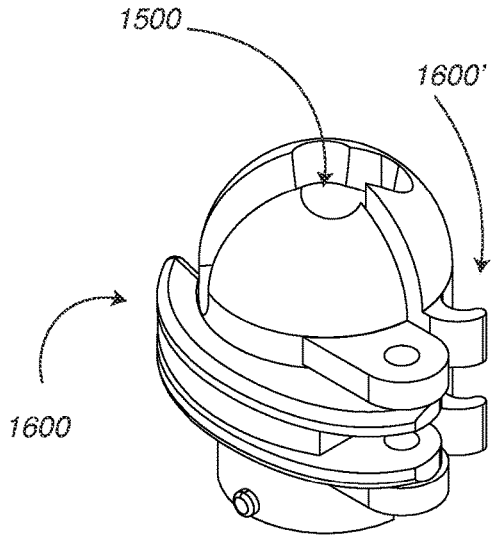
Figure 8C:
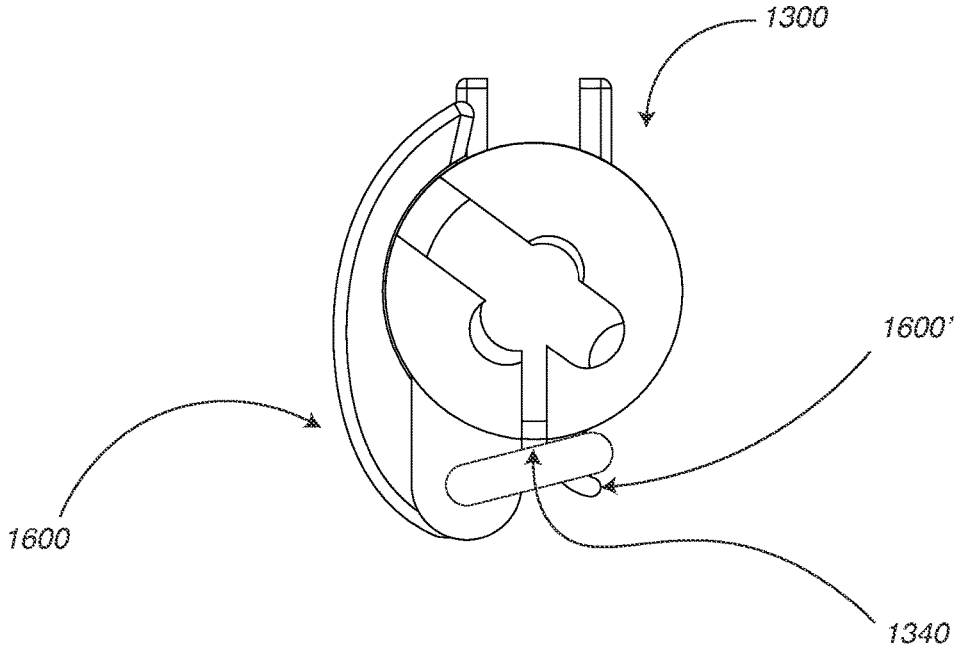

In certain embodiments, for example as shown in FIG. 8A—FIG. 8C, the cap 1300 comprises a longitudinal split 1340 extending through the thickness of the cap 1300 wherein the longitudinal split 1340 extends from the second end of the cap wherein it intersects with the opening, to the first end 1310 of the cap. The longitudinal split 1340 of the cap allows the constricting of the cap 1300 to maintain the ball and socket joint between the cap 1300 and the spheroid 1400 (FIG. 6) in a locked position. In certain embodiments a draw latch 1600 is interconnected to the cap 1300 wherein a first portion of the draw latch 1600 is interconnected to the cap on a first side of the longitudinal split 1340, and a second portion of the draw latch 1600' is interconnected to the cap on a second side of the longitudinal split 1340. Fastening the portions of the draw latch 1600 and engaging the draw latch 1600 serve to draw the first side of the longitudinal split 1340 toward the second side of the longitudinal split thereby reducing the width 1351 of the longitudinal split and constricting the cap inward. Constricting the cap inward serves to constrain the spheroid 1400 to the cap in a static position. It will be appreciated that the longitudinal split 1340 in the cap is one method of constraining the ball and socket joint mating of the cap and spheroid. It will be further appreciated that alternate methods of constraint between a ball and socket known to one skilled in the art intended to limit the movement of the spheroid in relation to the cap when in a locked configuration are within the spirit and scope of the present disclosure.

In certain embodiments, referencing FIG. 6, the constraint of the spheroid 1400 to a desired position is accomplished through the use of axial lock 1650 which is axially advanceable toward the spheroid 1400 once it has been configured as desired, thereby compressing the spheroid 1400 between the axial lock 1650 and the hemispherical shaped internal surface 1330 of the cap to provide a frictional hold. The axial lock 1650 comprises a concave hemispherical surface 1660 configured to receive an aspect of the spheroid therein to increase mating surface between the axial lock and the spheroid. It will be appreciated by those skilled in the art, that increased compression of the spheroid results in increased friction, and thereby increases the frictional hold of the spheroid between the axial lock and the internal hemispherical surface of the cap.

Certain embodiments, as shown in FIG. 6, comprise an adaptor insert 1700 wherein the adaptor insert 1700 is configured to be inserted within the first end 1110 of the sleeve wherein the adaptor insert allows for the adjustable grip system to be interconnected with varying diameter pole shafts. The adaptor insert comprises a key 1710 configured to mate with a key 1720 (FIG. 1C) within the first end of the sleeve to assist in alignment.

Figure 9A:
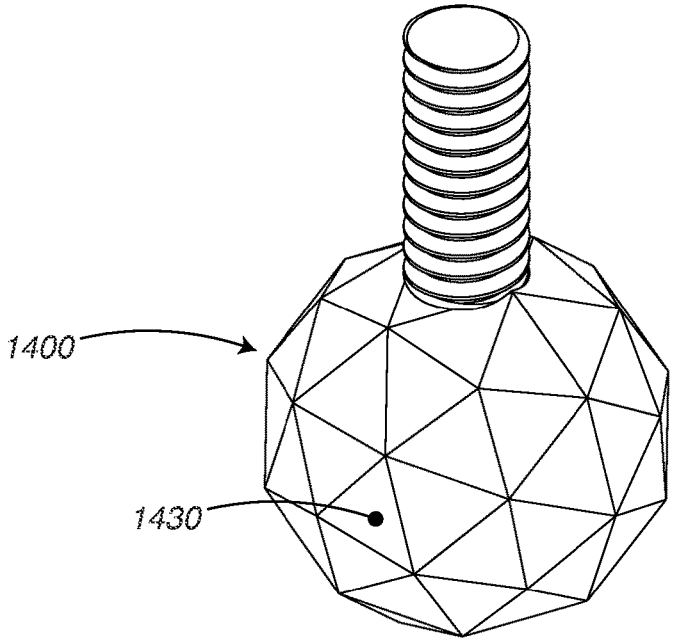
Figure 9B:
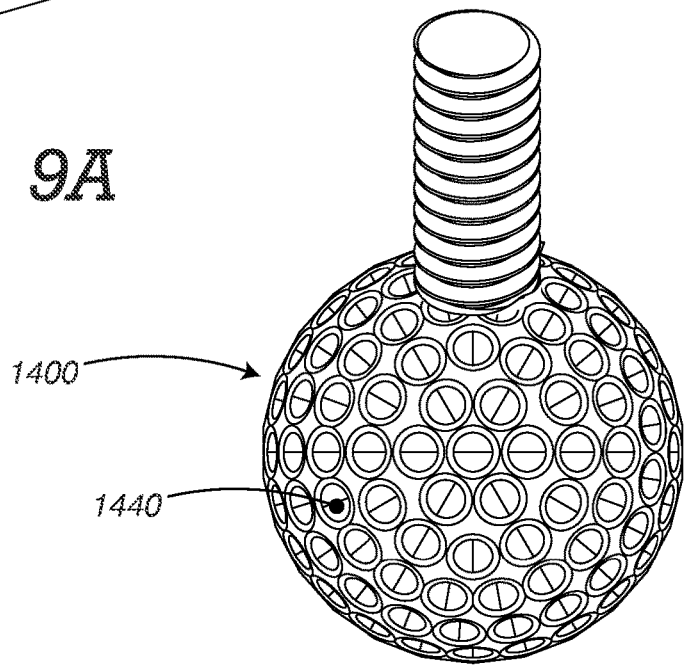

Certain embodiments, as shown in FIG. 9A—FIG. 9B, comprise a spheroid 1400 which comprise constraining features which allow for increased constraint between the cap and spheroid when placed in a locked configuration. Certain embodiments comprise a spheroid having a surface with a plurality of facets 1430, certain embodiments comprise a spheroid 1400 comprising a surface with a plurality of dimples 1440, and certain embodiments comprise a cap having at least one pin or detent extending radially inward from the internal surface of the cap wherein the at least one pin or detent is configured to contact the surface of the spheroid on a faceted face or within a dimple when advanced inward from the internal surface of the cap.

Figure 10A:
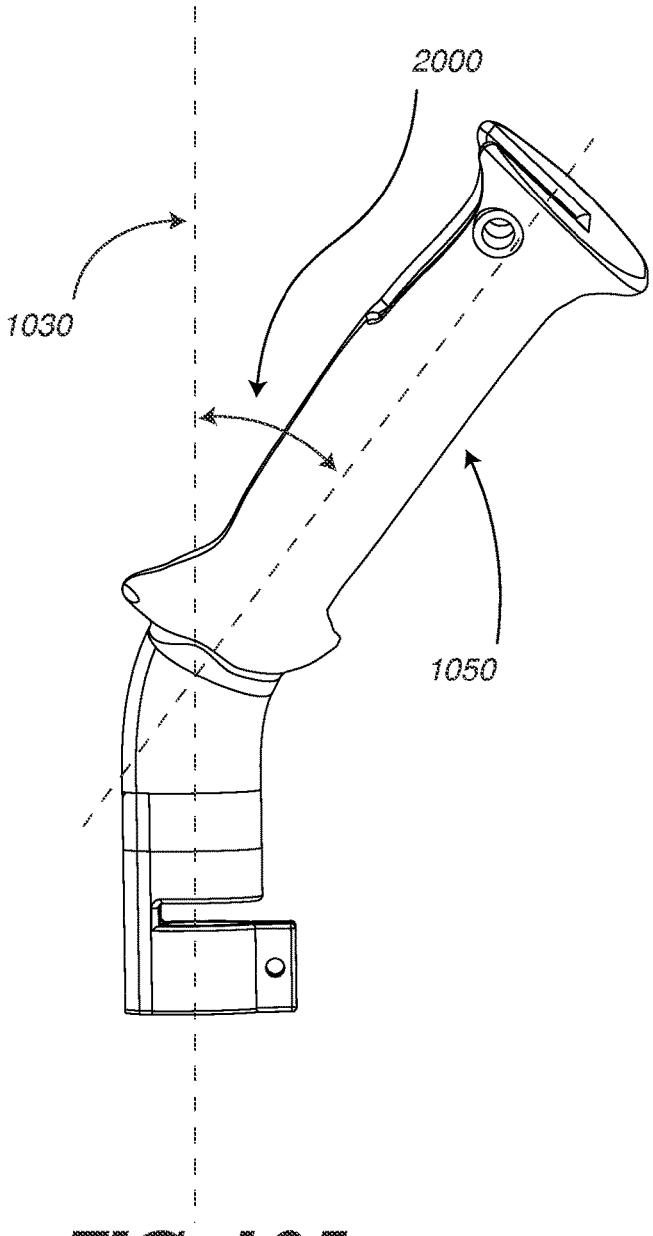
Figure 10B:
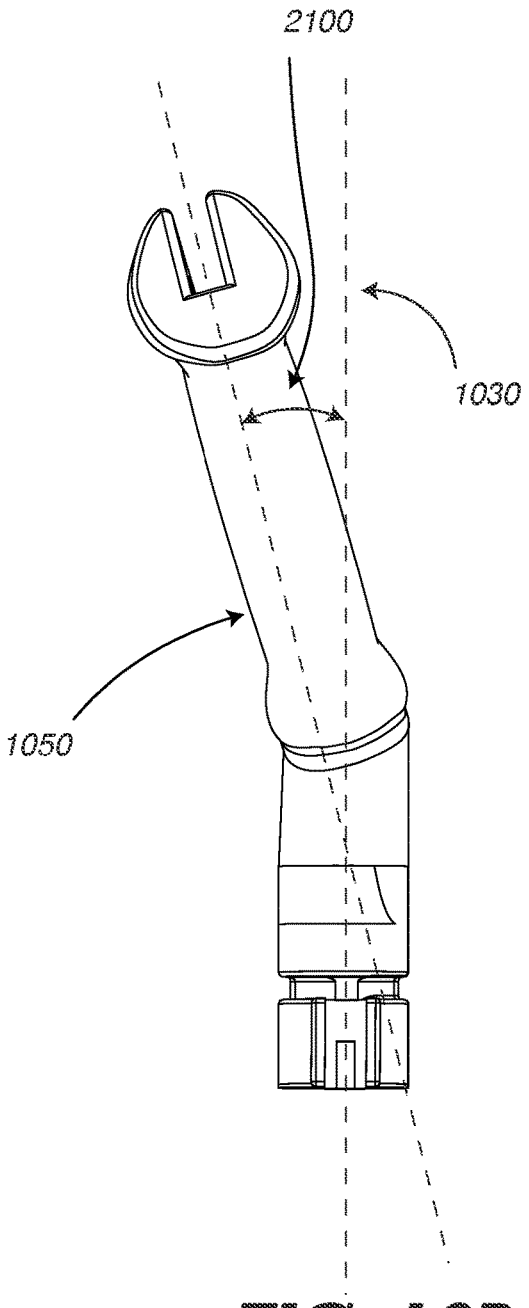
Figure 11C:
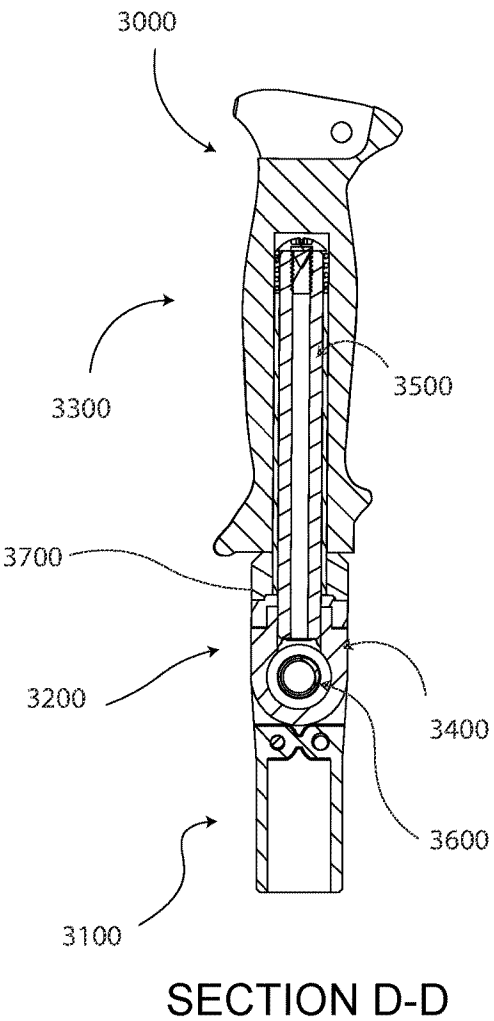
Figure 11B:
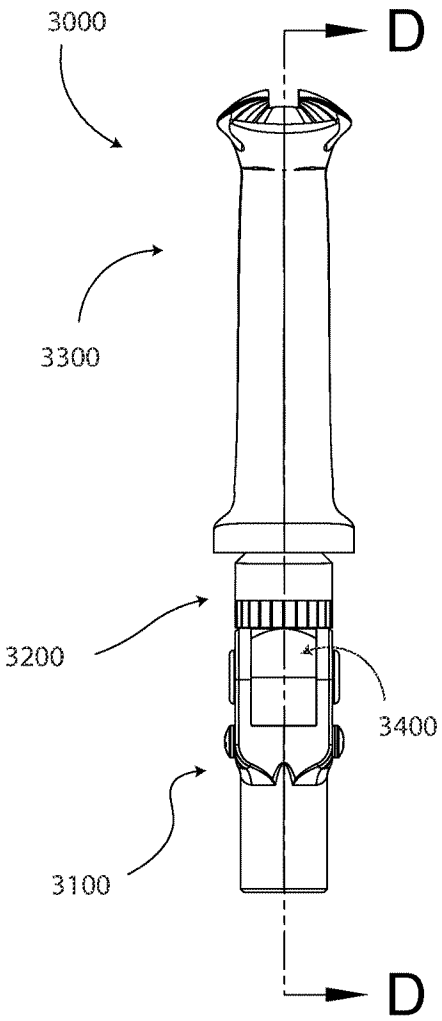
Figure 11A:
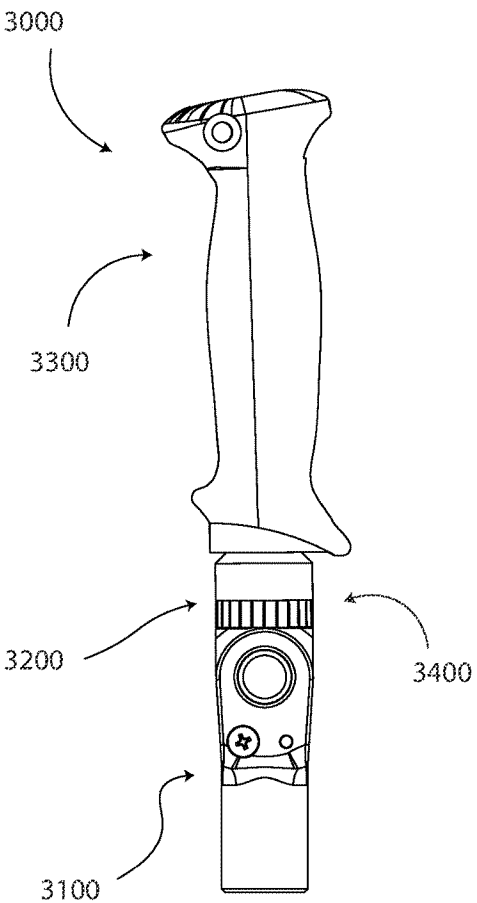
Figure 12A:
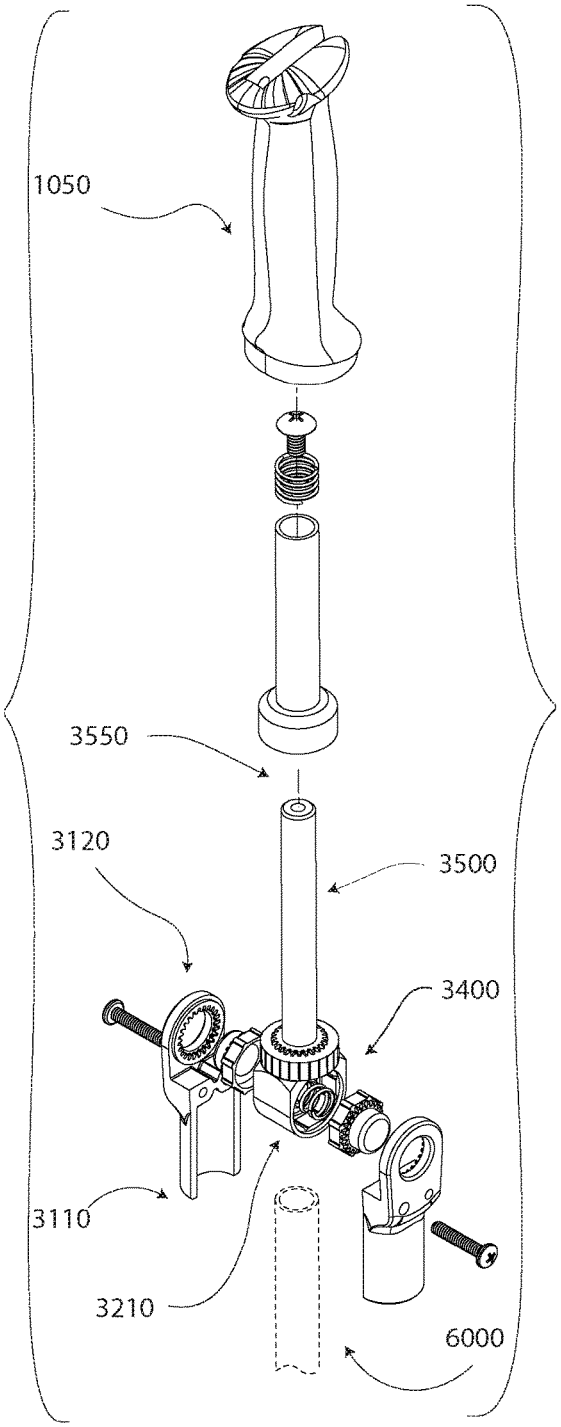
Figure 12B:
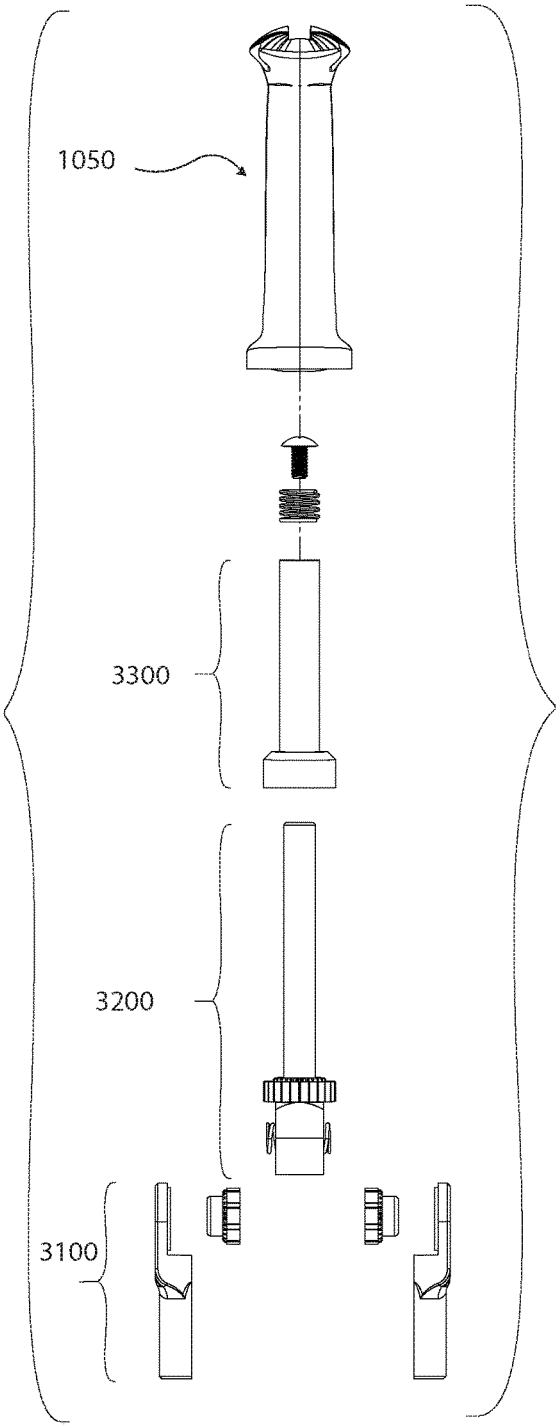
Figure 13A:
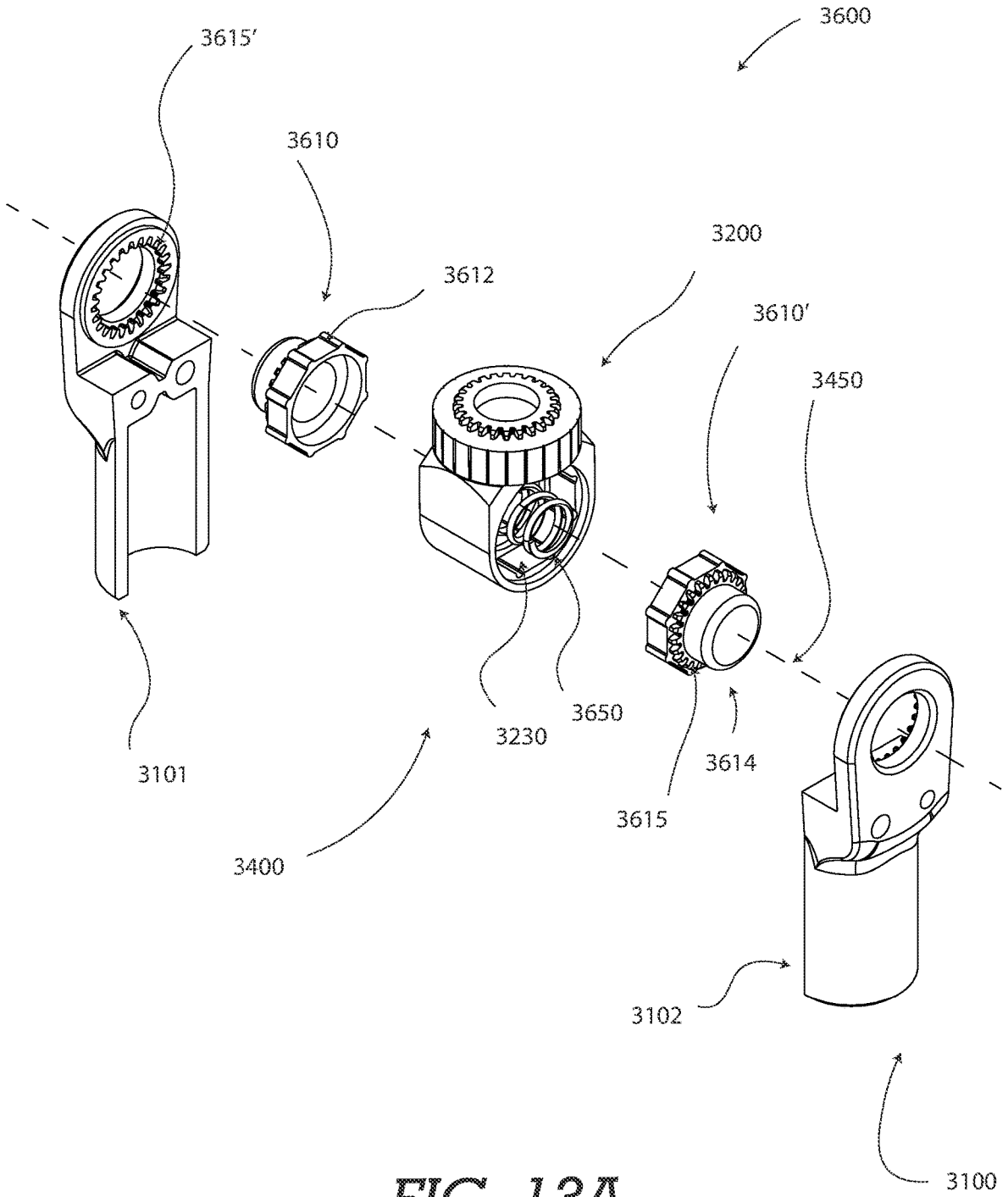
Figure 13D:
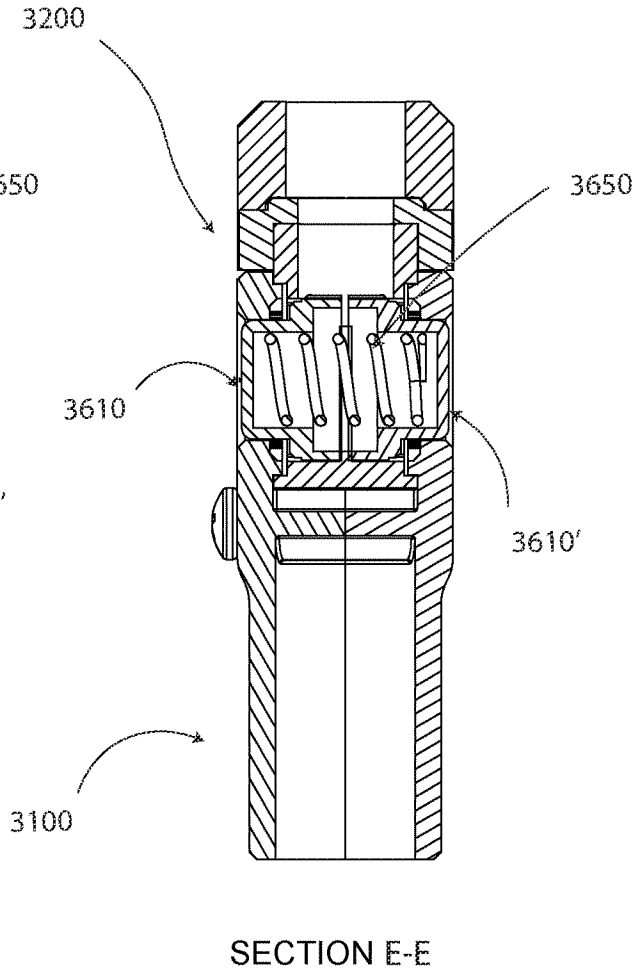
Figure 13C:
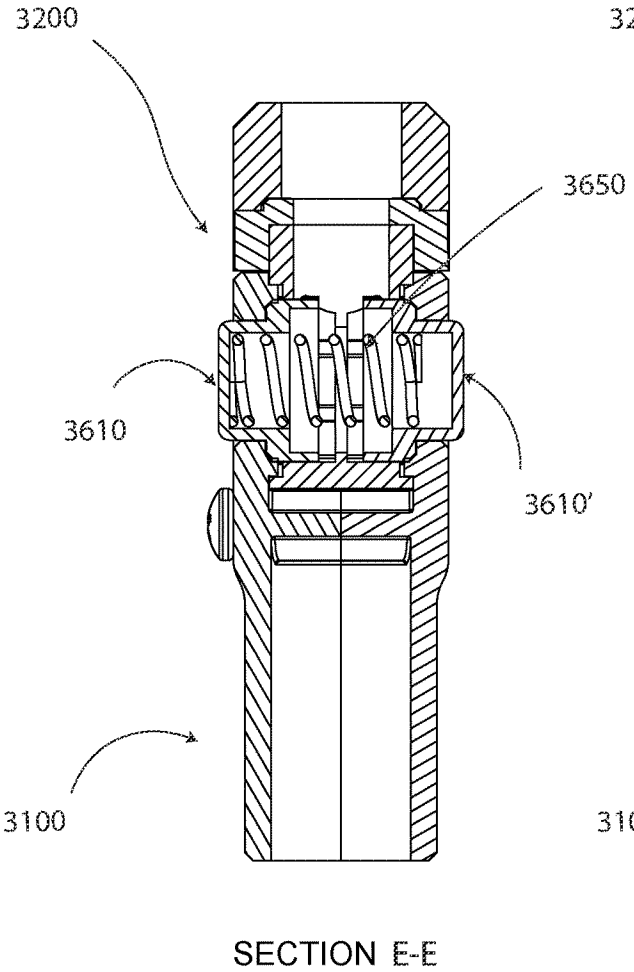
Figure 13B:
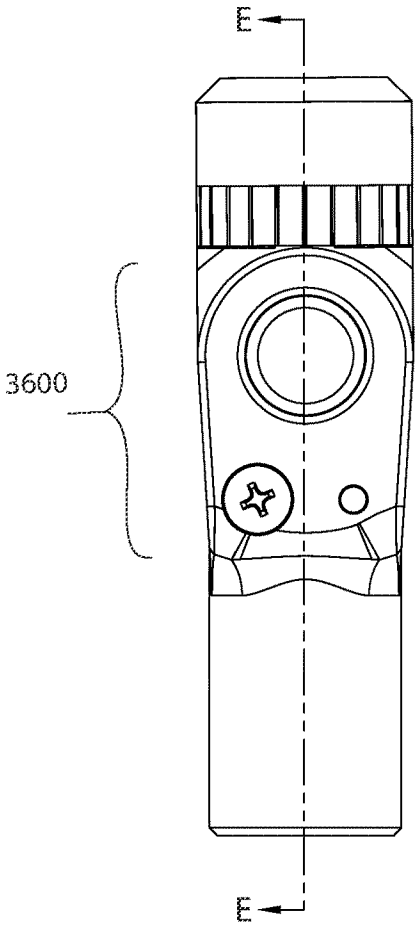
Figures 14A, 14B, 14C, 14D:
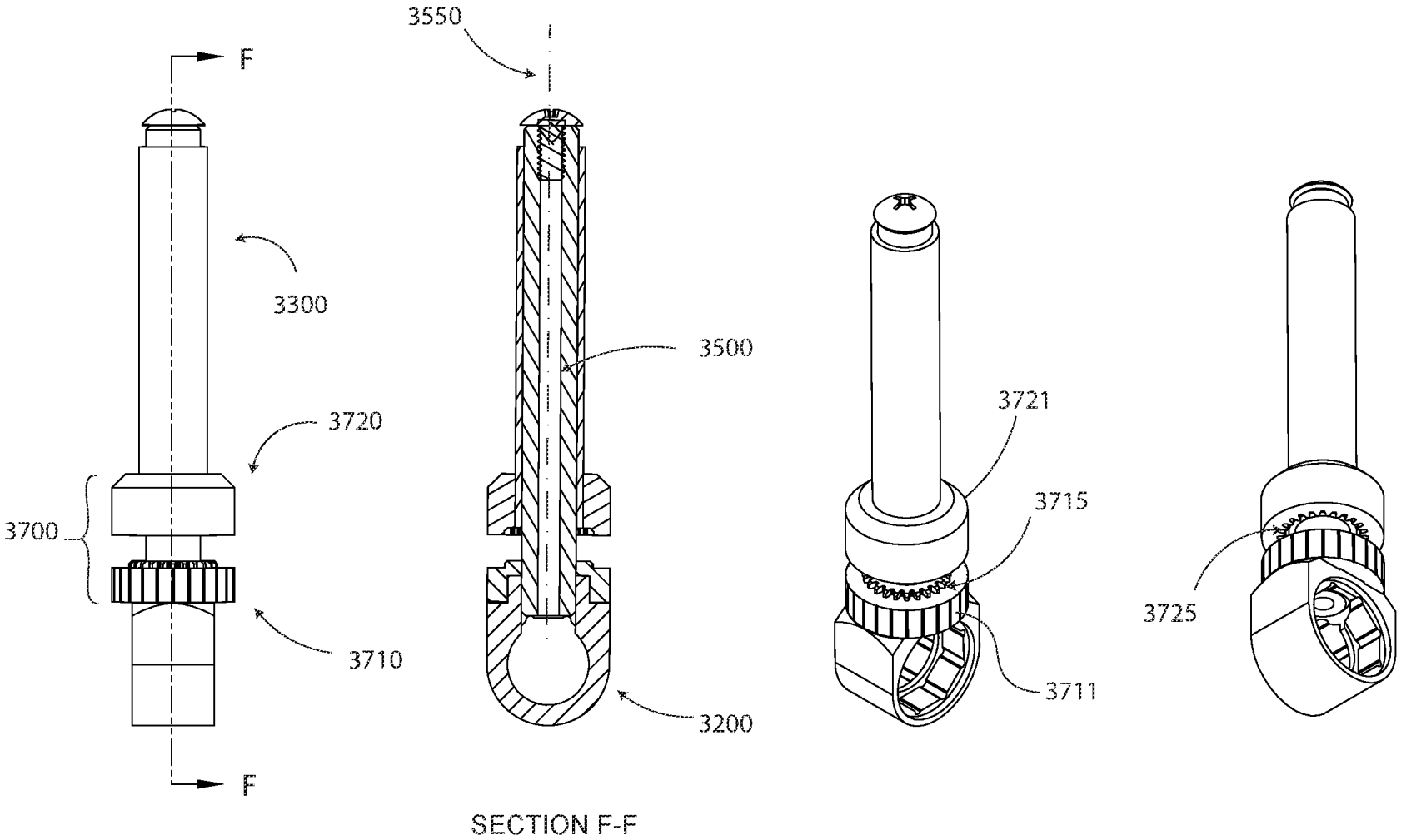
Figure 14E:
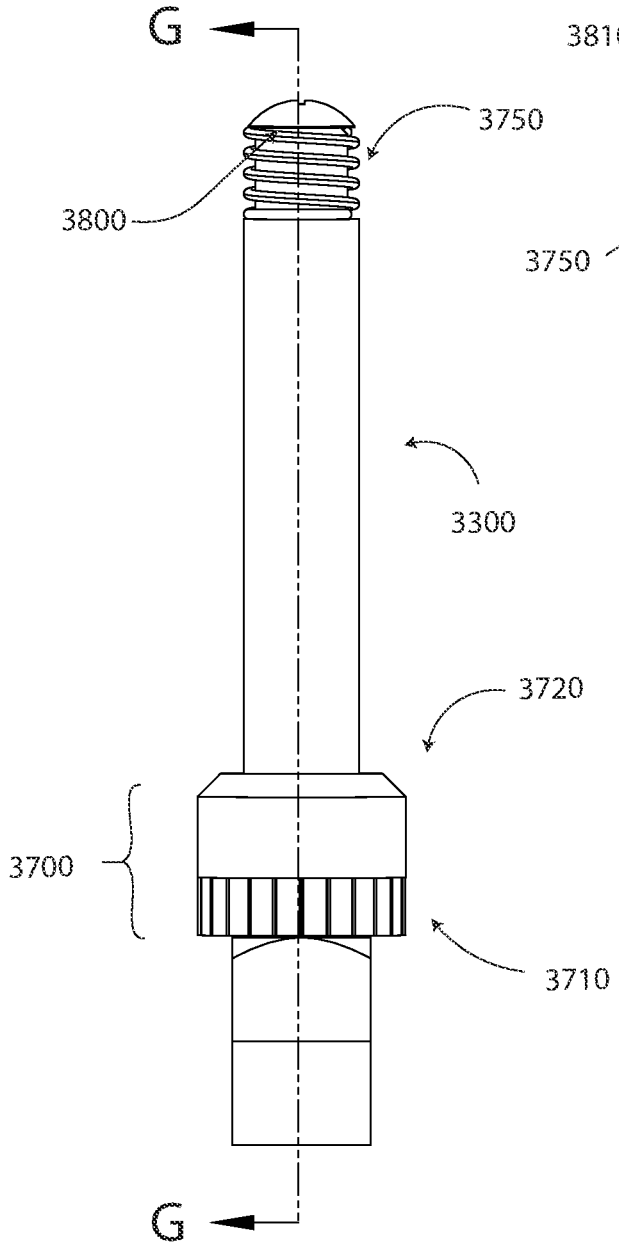
Figure 14F:
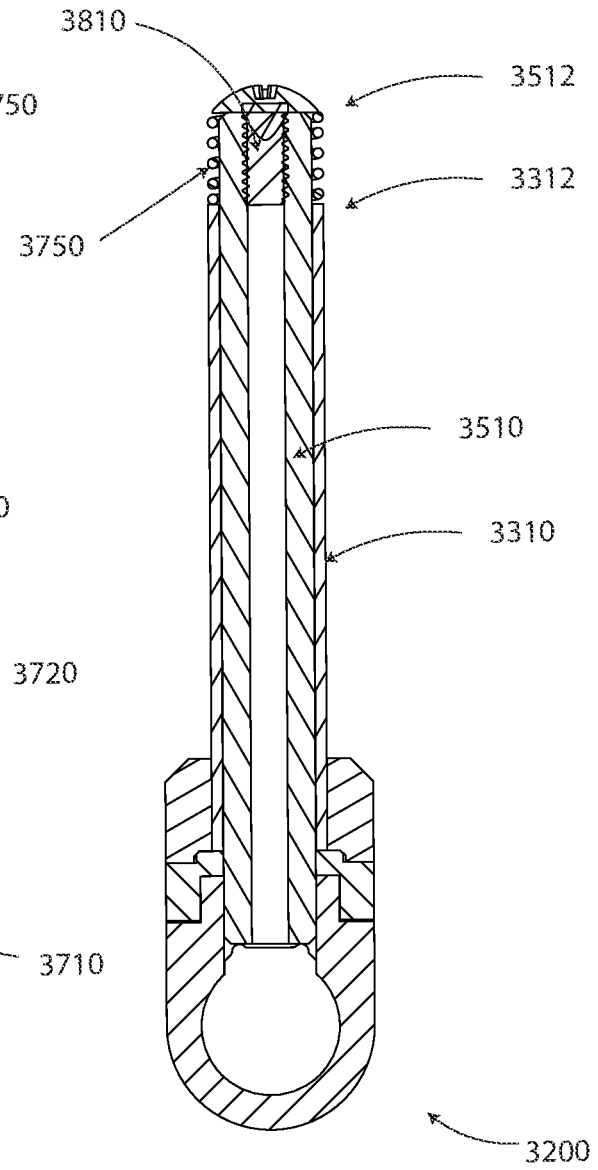

In certain embodiments, as shown in FIG. 10A—FIG. 10B, a grip system 1000 comprises a handle which has been affixed in place with a grip having a pitch forward 2000 away from the longitudinal axis 1030 and a pitch inward 2100 from the longitudinal axis 1030. In certain embodiments the grip has a forward pitch 2000 of 15 degrees forward and an inward pitch 2010 of 5 degrees inward toward a user. In alternative embodiments, the grip has a forward pitch 2000 of 20 degrees forward and an inward pitch 2010 of 10 degrees inward toward the user. It will be appreciated that alternate embodiments having a forward pitch and inward pitch of angles between 0 and 90 degrees are within the spirit and scope of the present disclosure.

In certain embodiments of the present disclosure, as shown in FIG. 11A—FIG. 12B for example, an adjustable grip system 3000 comprises a first portion 3100 having a first end 3110 configured to receive a shaft (e.g., pole 6000) of a trekking pole therein. A second end 3120 of the first portion is interconnected with a first end 3210 of a second portion at a joint 3400. The joint 3400 is configured to permit the rotation of the second portion 3200 in relation to the first portion 3100 about a first axis 3450. The second portion 3200 further comprises an axial member 3500 (e.g., a shaft) extending away from the joint 3400. A longitudinal axis of the axial member provides a second axis 3550 of the adjustable grip system. A third portion 3300 is slidably interconnected with the second portion 3200 wherein the third portion 3300 is configured to slide longitudinally along the axial member 3500, and wherein the third portion 3300 is configured to rotate about the second axis 3550. The third portion 3300 is configured to interconnect with a grip 1050 to provide a gripping surface for a user. Although embodiments shown herein demonstrate a grip 1050 and a third portion 3300 as separate elements, alternate embodiments wherein the grip 1050 and third portion 3300 are a unitary element are within the spirit and scope of the present disclosure.

In certain embodiments, as shown in FIG. 13 for example, an adjustable grip system comprises a first locking mechanism 3600 configured to constrain the movement of the joint 3400, thus constraining the rotational movement of the second portion 3200 in relation to the first portion 3100. The first locking mechanism 3600 of certain embodiments comprises at least a first button wherein depressing the first button 3610 unlocks the joint 3400 and allows a user to rotate the second portion 3200 in relation to the first portion 3100. In certain embodiments the first portion comprises a clevis form, and in certain embodiments the first portion comprises a first half 3101 and a second half 3102. The first button 3610 of certain embodiments is coincident with the first axis 3450, while in further embodiments, the first button 3610 is coaxial with the first axis 3450. Certain embodiments of the first locking mechanism 3600 comprises a spring 3650, such as a compressive spring, configured to force the first button 3610 laterally outward from the joint 3400. Forcing the first button 3610 away from the joint 3400 causes the first locking mechanism 3600 to lock the joint 3400 and constrain the rotational motion of the second portion 3200 in relation to the first portion 3100.

In certain embodiments, a first button 3610 for unlocking the first locking mechanism 3600 comprises a medial 3612 aspect which is keyed to the second portion 3200 of the adjustable grip system, and further comprises a lateral aspect 3614 which is keyed to the first portion 3610 of the adjustable grip system. When the first button 3610 is depressed, the lateral aspect 3614 disengages from the first portion 3100 while the medial aspect 3612 remains engaged with the second portion 3200, thereby allowing the rotation of the second portion 3200 in relation to the first portion 3100. When the first button 3610 is released and forced laterally outward, the lateral aspect 3614 of the first button re-engages with the first portion 3100 and thereby constrains once again the rotation of the first portion 3100 in relation to the second portion 3200. Embodiments as shown comprise a lateral portion 3614 having a plurality of protuberances 3615 and the first portion having a plurality of protuberances 3615' configured to intermesh—similarly to a first face gear intermeshing with a second face gear wherein the protuberances 3615' of the first portion and the protuberances 3615 of the button are configured to interdigitate with each other. However, alternate keyed solutions which provide mechanical constraint between the button 3610 and the first portion 3100, including key and slot configurations, are within the spirit and scope of the present disclosure. Furthermore, embodiments as shown comprise a medial portion 3612 having a polygonal form wherein the interior aspect 3230 of the second portion comprises a similarly shaped polygonal form configured to receive the medial aspect 3612. However, alternate keyed solutions which provide mechanical constraint between the first button 3610 and the second portion 3200 when engaged, including key and slot configurations, are within the spirit and scope of the present disclosure.

Certain embodiments of the present disclosure comprise a first button 3610 and a second button 3610' axially opposed to each other wherein the depressing of the first button 3610 and the second button 3610' medially inward results in the unlocking of the first locking mechanism 3600 and thereby allows the rotational movement of the second portion 3200 in relation to the first portion 3100. Similarly, when the first button 3610 and second buttons 3610' are released, the buttons are forced outward by the spring 3650, thus locking the first locking mechanism 3600 and constraining the rotational motion between the second portion 3200 and the first portion 3100.

Certain embodiments of the present disclosure, as shown in FIG. 14A—FIG. 14F for instance, comprise a second locking mechanism 3700 configured to constrain the third portion 3300 from axially rotating about the second axis 3550 in relation to the second portion 3200. The second locking mechanism 3700 of certain embodiments comprises a first keyed element 3710 interconnected with the second portion 3200, wherein the first keyed element 3710 is unable to rotate in relation to the second portion 3200, and a second keyed element 3720 interconnected with the third portion 3300 wherein the second keyed element 3720 is unable to rotate in relation to the third portion 3300. The first keyed element 3710 and the second keyed element 3720 are configured and keyed to intermesh with each other such that when they are forced together, the first keyed element 3710 and second keyed element 3720 are unable to rotate in relation to each other. Forcing the third portion 3300 slidably toward the second portion 3200 along the axial member 3500 engages the first keyed element 3710 with the second keyed element 3720, thereby intermeshing the first keyed element 3710 with the second keyed element 3720 and constraining the rotation of the third portion 3300 in relation to the second portion 3200. Thus, forcing the third portion 3300 toward the second portion 3200 locks second locking mechanism 3700 and constrains the rotation of the third portion 3300 in relation to the second portion 3200. As shown, the first keyed element 3710 comprises protuberances 3715 configured to intermesh with protuberances 3725 of the second keyed element, similarly to the intermeshing of a first face gear and a second face gear wherein the protuberances 3715 of the second portion and the protuberances 3725 of the third portion are configured to interdigitate with each other. However, alternate embodiments wherein the first keyed element 3710 and the second keyed element 3720 comprise a key and slot or other elements configurated to intermesh to limit rotational movement of the third portion in relation to the second portion are within the spirit and scope of the present disclosure.

In certain embodiments the keyed elements of the second locking mechanism 3700 comprise a first collar 3711 and a second collar 3722 keyed to each other wherein the intermeshing of the keyed elements constrains the rotational movement of the third portion 3300 in relation to the second portion 3200. In certain embodiments the keyed elements allow intermeshing on a plurality of angular intervals. In certain embodiments, the first keyed element 3710 and the second keyed element 3720 can be intermeshed on intervals of 12-degrees for a full 360-degree rotational range. Although certain angular intervals 3730 are shown and discussed herein, alternate intervals of intermeshing between the first keyed element and the second keyed element are considered within the spirit and scope of the present disclosure.

In certain embodiments, a spring 3750 is configured to force the third portion 3300 toward the second portion 3200, thereby the second locking mechanism is configured to be locked unless the third portion 3300 is pulled away from the second portion 3200 to disengage the keyed elements 3710, 3720 away from each other.

In certain embodiments, the axial member 3500 of the second portion comprises a shaft 3510, and the third portion 3300 comprises a sleeve 3310 configured to axially receive the shaft of the second portion therein, wherein a distal end 3512 of the axial member extends beyond the distal end 3312 of the sleeve. A mechanical stop 3800, which comprises a screw 3810 interconnected to the distal end 3512 of the axial member in certain embodiments, allows for a spring 3750 to be disposed between the distal end 3512 of the axial member and the distal end 3312 of the sleeve wherein the compressive spring 3750 bears on the mechanical stop 3800 to force the third portion 3300 toward the second portion to intermesh the keyed elements 3710, 3720.

In some embodiments, as shown illustrate and describe a first portion 3100 comprising a clevis form configured to receive and interconnect with a second portion 3200 comprising a form within the clevis to result in a joint between the first portion 3100 and the second portion 3200 which allows the rotation of the second portion 3200 in relation to the first portion 3100 around the first axis 3450. In some alternate embodiments as illustrated in FIG. 15A—FIG. 16G, the second portion 3200 comprises a clevis form configured to receive and interconnect with the first portion 3100 within the clevis to result in a joint between the first portion 3100 and the second portion 3200 which allows the rotation of the second portion 3200 in relation to the first portion 3100 around the first axis 3450. Embodiments illustrated and described herein surround the use of a clevis connection to enable a joint between the first portion 3100 and the second portion, however alternate joints and connection types between the first portion and second portion which allow the rotation of the second portion 3200 about a first axis 3450 in relation to the first portion are within the spirit and scope of the present disclosure.

In some embodiments of the present disclosure, the grip comprises a longitudinal recess 1070 configured to slidably interconnect with a second shaft 3510 connected to the second portion 3200. The second shaft 3510 extends away from the joint wherein the second shaft 3510 is optionally perpendicular to the first axis 3450, and wherein the second shaft 3510 comprises a second axis 3550 which is optionally coaxial with the second shaft 3510.

In some embodiments, as illustrated in FIG. 15A—FIG. 16G, the grip 1050 is affixed and/or constrained to the second shaft 3510 with a fastener 3815 (e.g., male threaded fastener, female threaded fastener, cam-lock, quarter-turn fastener, quick disconnect fastener, ball-detent fastener) wherein the fastener 3815 extends from an external aspect of the grip to interconnect with the second shaft 3510 and/or elements within the second shaft 3510.

In one or more embodiments of the present disclosure, a second locking mechanism 3700 comprises a first keyed element 3710 interconnected to the second portion 3200, and a second keyed element 3720 interconnected with the grip, and optionally with a first end 1051 of the grip. When the grip 1050 is pulled away from the second portion 3200 in a first direction coaxial with the second axis 3550, the second keyed element 3720 is disengaged from the first keyed element 3710, and the grip is permitted to rotate about the second axis 3550. When the grip is pushed toward the joint in a second direction, opposite the first direction, pushing the second keyed element 3720 toward the first keyed element 3710 results in the second keyed element 3720 to engage with the first keyed element 3710, and the grip 1050 is constrained from rotating about the second axis 3550.

In one or more embodiments the second shaft 3510 comprises a hollow aspect wherein a spring 3820 is contained within the second shaft 3510 wherein the spring 3820 is optionally coaxially located with the second axis 3550. The grip 1050 is optionally interconnected with the spring 3820 by a first fastener 3815 wherein the first fastener 3815 extends from an external aspect of the grip, through the spring 3820, and engages with a second fastener 3825 within the second shaft 3510, thereby engaging the spring 3820. In one or more embodiments the fastener 3815 extends through the grip 1050 from a second end 1052 of the grip. When the grip 1050 is pulled away from the second portion 3200 in a first direction coaxial with the second axis 3550, the spring 3520 is compressed, the second keyed element 3720 is disengaged from the first keyed element 3710, and the grip 1050 is permitted to rotate about the second axis 3550, thus allowing a user to adjust the rotation of the grip 1050 about the second axis 3550. When the grip is subsequently released, the spring 3820 expands, pushing the second keyed element 3720 toward the first keyed element 3710 resulting in the second keyed element 3720 to engage with the first keyed element 3710, and the grip 1050 is constrained from rotating about the second axis 3550.

In one or more embodiments, as shown in FIG. 15A—FIG. 15D for example, an adjustable grip system comprises a first locking mechanism configured to constrain the movement of the joint 3400, thus constraining the rotational movement of the second portion 3200 in relation to the first portion 3100. The first locking mechanism of certain embodiments comprises at least a first button 3610 wherein depressing the first button 3610 unlocks the joint 3400 and allows a user to rotate the second portion 3200 in relation to the first portion 3100. In certain embodiments the second portion 3200 comprises a clevis form, and in certain embodiments the second portion comprises a first half 3200 and a second half 3200'. The first button 3610 of certain embodiments is coincident with the first axis 3450, while in further embodiments, the first button 3610 is coaxial with the first axis 3450. Certain embodiments of the first locking mechanism 3600 comprises a spring 3650, such as a compressive spring, configured to force the first button 3610 laterally outward from the joint 3400. Forcing the first button 3610 away from the joint 3400 causes the first locking mechanism 3600 to lock the joint 3400 and constrain the rotational motion of the second portion 3200 in relation to the first portion 3100.

In certain embodiments, when the first button 3610 is depressed, a lateral aspect of the first button 3610 disengages from the second portion 3200 while a medial aspect of the first button 3610 remains engaged with the first portion 3100, thereby allowing the rotation of the second portion 3200 in relation to the first portion 3100. When the first button 3610 is released and forced laterally outward, the lateral aspect of the first button re-engages with the first portion 3200 and thereby constrains once again the rotation of the first portion 3100 in relation to the second portion 3200.

Certain embodiments of the present disclosure comprise a first button 3610 and a second button 3610' axially opposed to each other wherein the depressing of the first button 3610 and the second button 3610' medially inward results in the unlocking of the first locking mechanism 3600 and thereby allows the rotational movement of the second portion 3200 in relation to the first portion 3100. Similarly, when the first button 3610 and second buttons 3610' are released, the buttons are forced outward by the spring 3650, thus locking the first locking mechanism 3600 and constraining the rotational motion between the second portion 3200 and the first portion 3100.

Figure 15A:
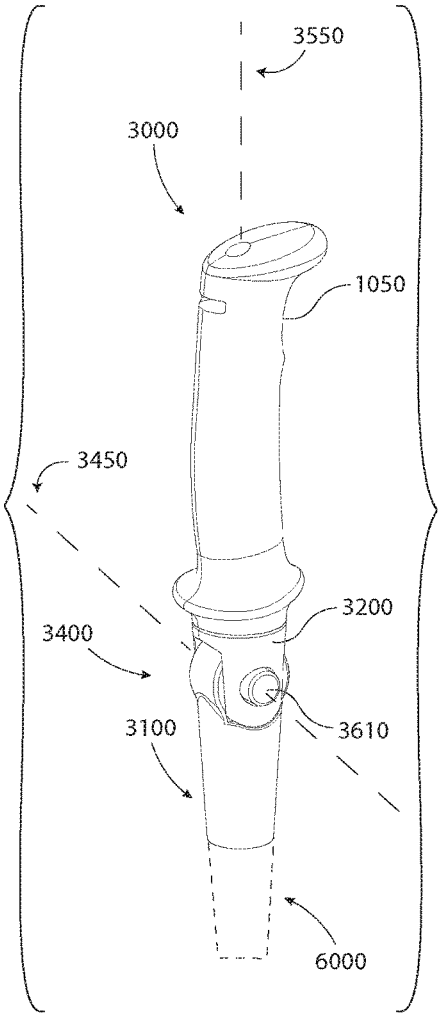
Figure 15B:
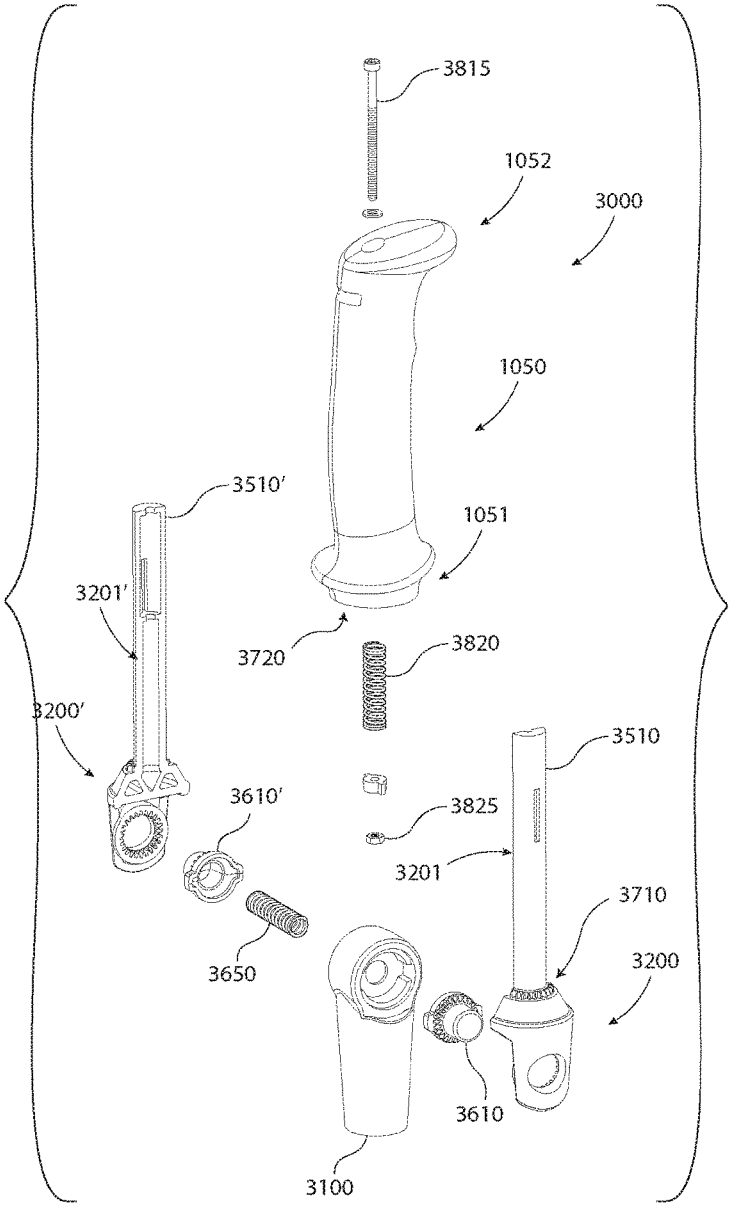
Figure 15C:
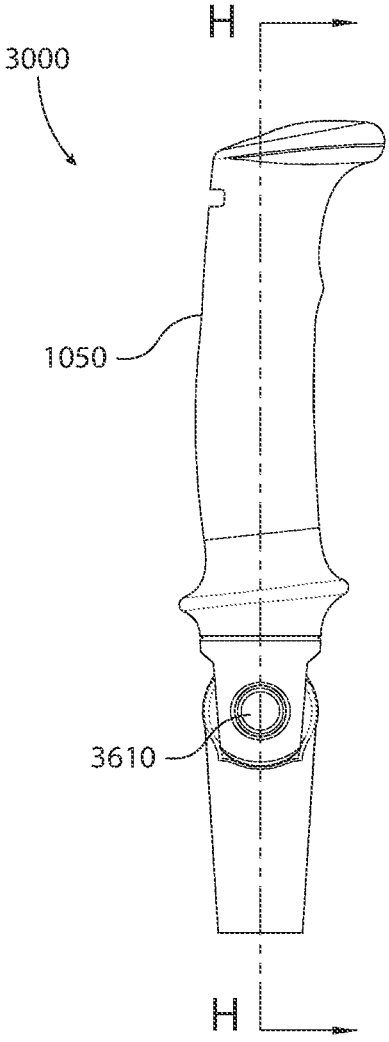
Figure 15D:
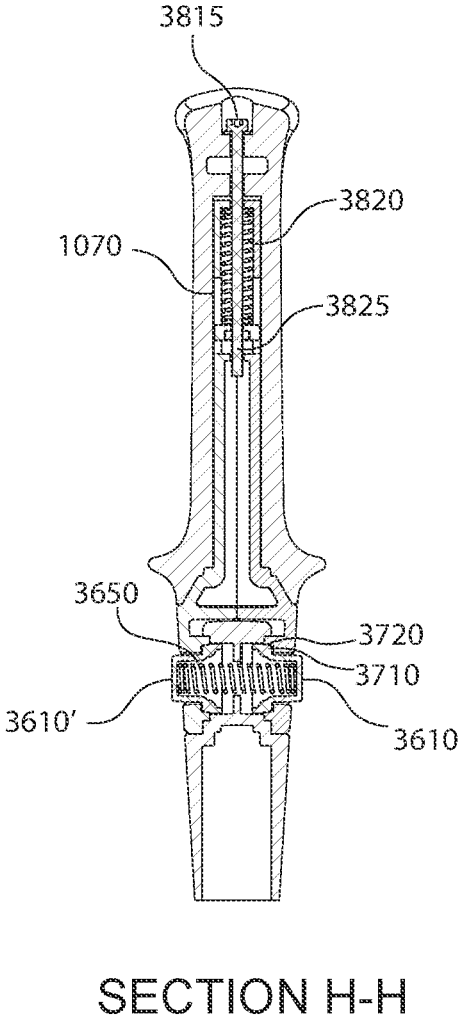

In one or more embodiments of the present disclosure, as illustrated in FIG. 15B for instance, the second portion 3200 comprises a first lateral portion 3200 and a second lateral portion 3200' wherein the interconnection of the first lateral portion 3200 and the second lateral portion 3200' results in a second portion 3200 as shown in FIG. 15A for instance. In one or more embodiments, the first lateral portion 3200 comprise a first lateral portion 3510 of the second shaft and a second lateral portion 3510' of the second shaft. In one or more embodiments the first lateral portion 3200 of the second portion and the second lateral portion 3200' comprise interfacing surfaces (3201, 3201') which are optionally parallel and/or coplanar with the second axis 3550.

In one or more embodiments the of the present disclosure, as illustrated in FIG. 16A—FIG. 17F, the joint 3400 between the first portion 3100 and the second portion 3200 comprises a keyed pin 3900 wherein the insertion of the keyed pin 3900 within the joint 3400 prevents the rotation of the second portion 3200 in relation to the first portion 3100. In one or more embodiments the first end 3210 of the second portion comprises one or more apertures (e.g. keyed holes 3211, 3211') therethrough, and the and the second end 3120 of the first portion comprises one or more apertures 3111 therethrough, wherein the first end 3210 of the second portion and the second end 3120 of the first portion are configured to interconnect wherein the apertures of the first portion and the apertures of the second portion align for instance as shown in FIG. 16A—FIG. 16D, wherein the apertures are configure to receive the keyed pin 3900 therethrough. When the apertures of the first portion and the second portion are aligned, and the keyed pin 3900 inserted therethrough, the joint 3400 is constrained and prevents the rotation of the second portion 3200 in relation to the first portion 3100.

In one or more embodiments of the present disclosure, as illustrated in FIG. 17A—FIG. 17F for instance, the keyed pin 3900 optionally comprises a female threaded features, a male threaded features, through hole configured to receive a retainer clip, a distal end configured to receive a circlip, and/or a distal end configured to receive a crimped fastener. Each of the embodiments illustrated in FIG. 17A—FIG. 17F show a secondary fastener 3910 configured to interconnect with the keyed pin, but embodiments are not limited thereto. In one or more embodiments the cross-sectional profile of the keyed pin 3900 comprises an asymmetric shape, a symmetric shape, a polygonal shape, an oblong shape, a round shape with keyed recesses, a star shape, and/or shapes which the rotation of the second portion in relation to the first portion when the keyed pin 3900 is inserted through the one or more apertures 3111 of the first portion and the one or more apertures 3211 of the second portion.

Figure 16A:
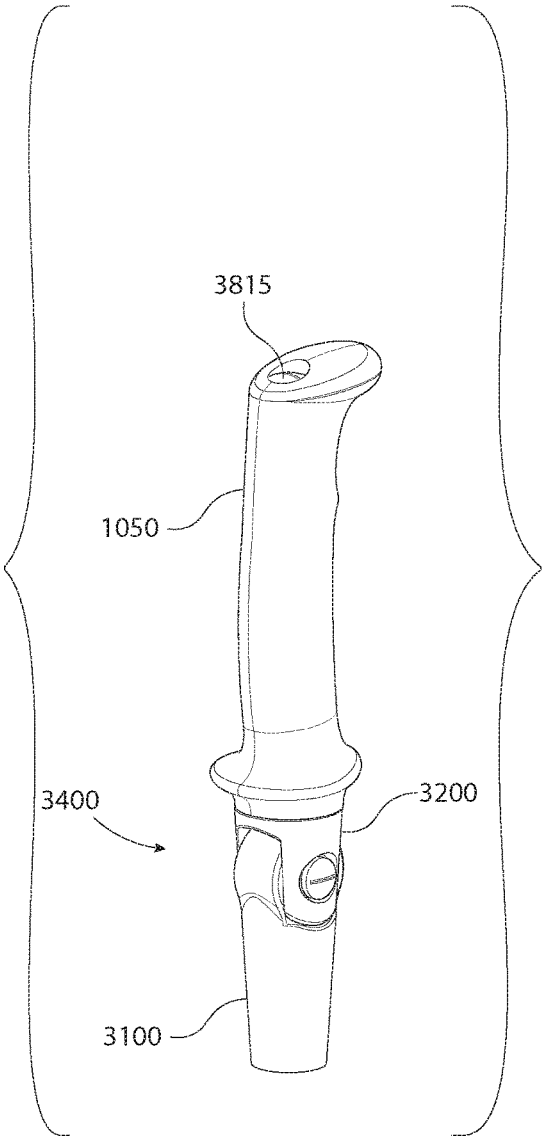
Figure 16B:
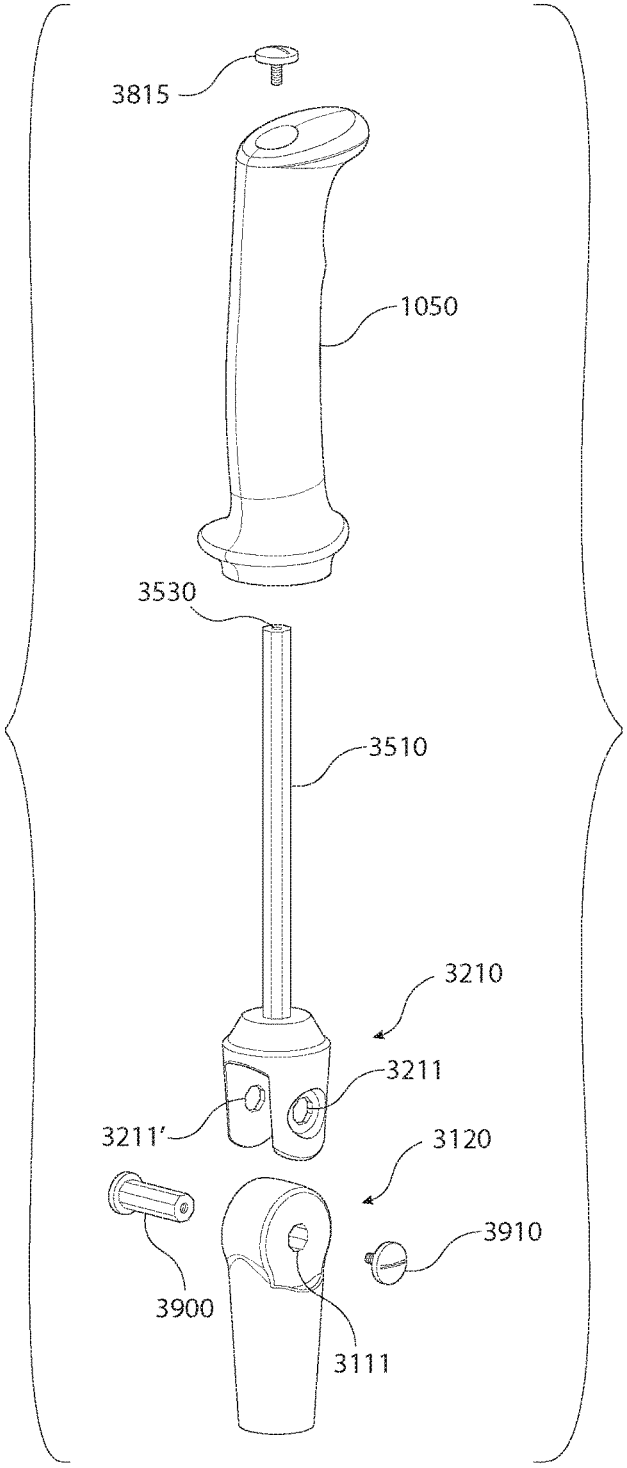
Figure 16C:
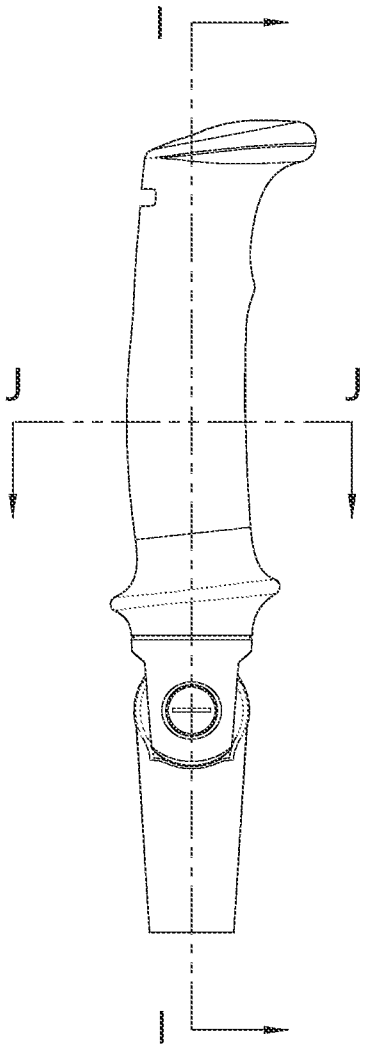
Figure 16D:
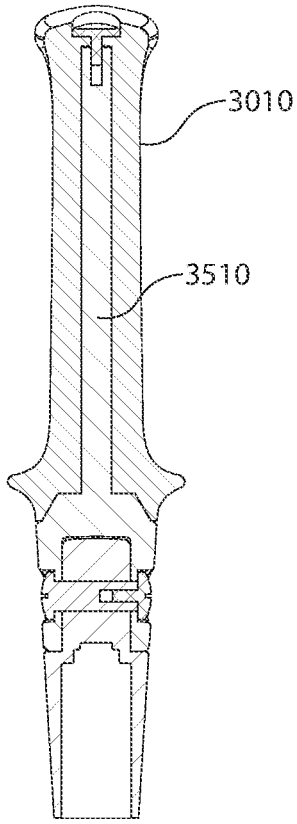
Figure 16E:
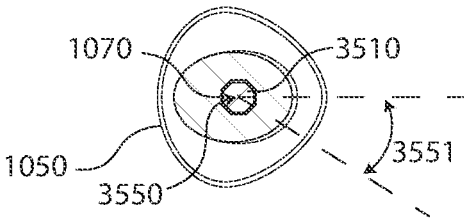
Figure 16F:
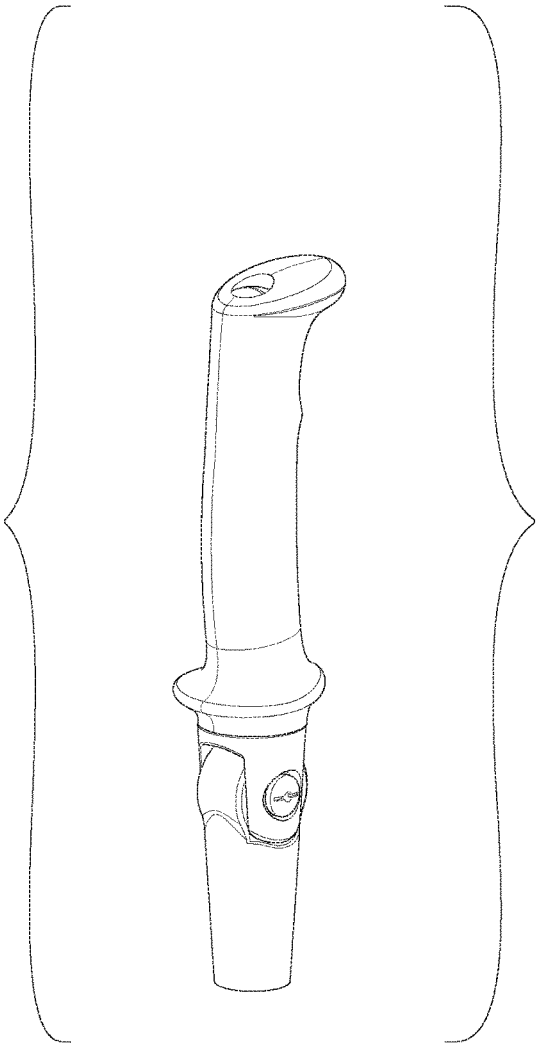
Figure 16G:
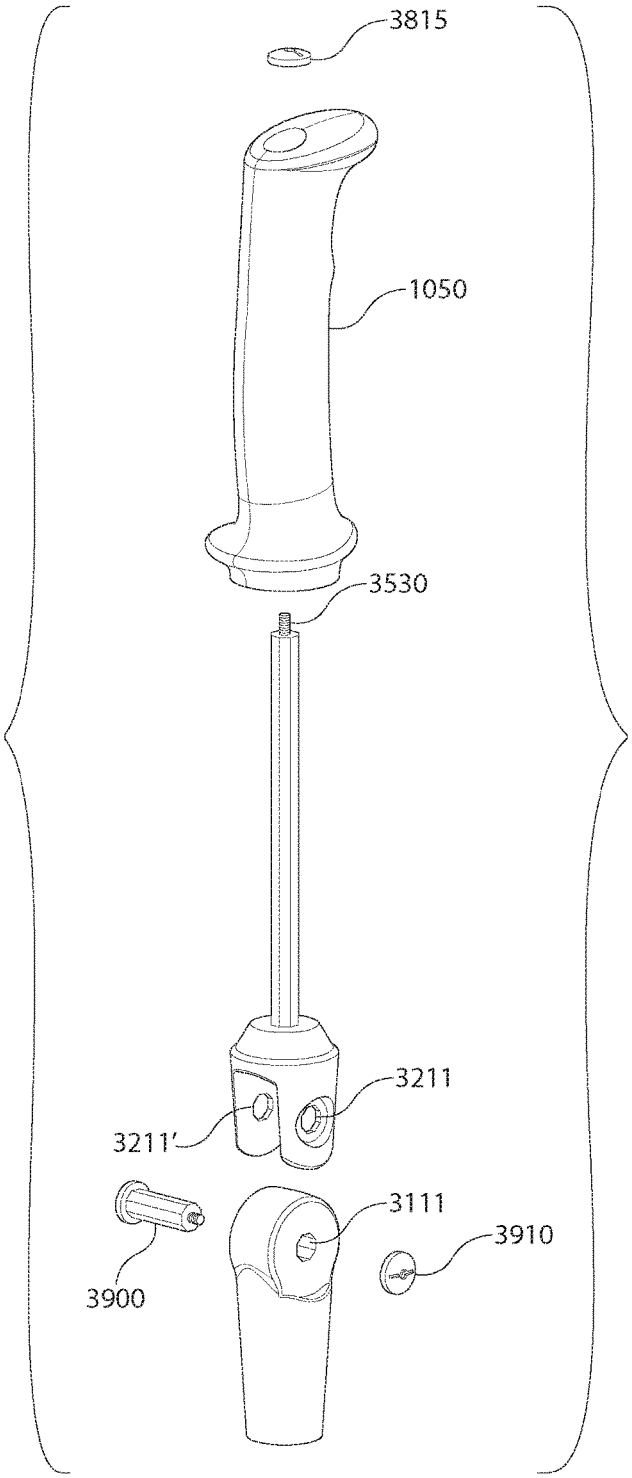
Figure 17A:
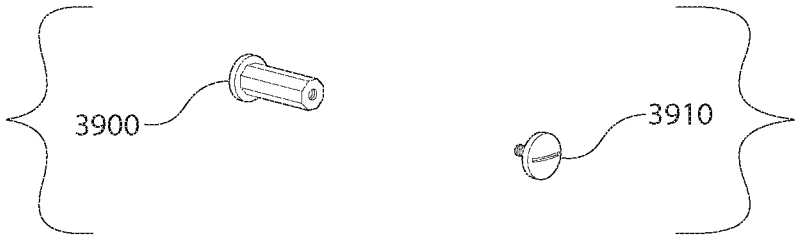
Figure 17B:
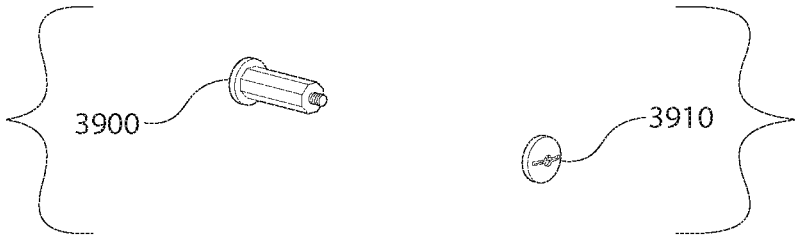
Figure 17C:
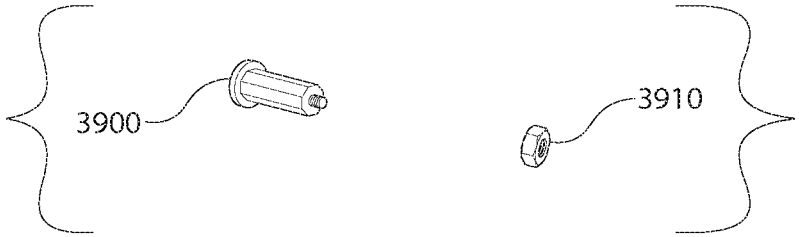
Figure 17D:
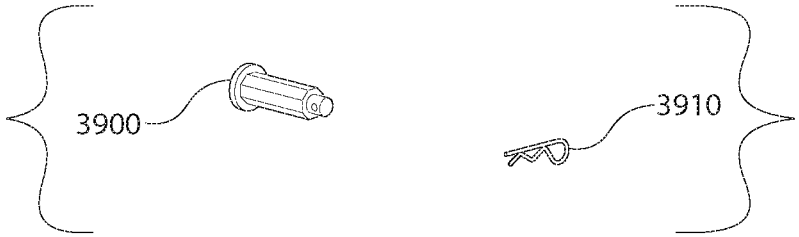
Figure 17E:
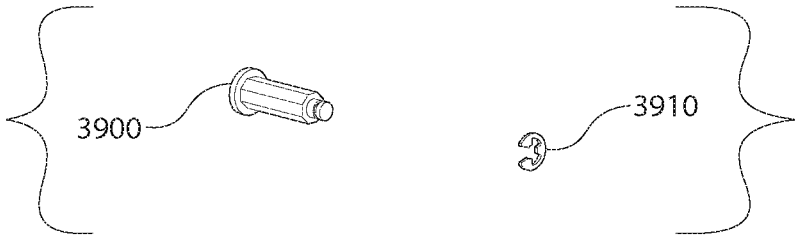
Figure 17F:
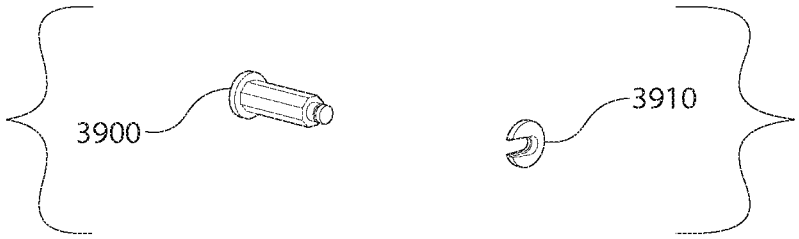

In one or more embodiments, as illustrated in FIG. 16C—FIG. 16E for instance, the second shaft 3510 comprises a keyed cross-sectional profile as shown in FIG. 16E for instance, wherein the longitudinal recess 1070 of the grip is configured to interconnect with the keyed cross-sectional profile of the second shaft 3510. In one or more embodiments the longitudinal recess comprises a cross-sectional profile which matches the cross-sectional profile of the second shaft 3510, however embodiments described herein are not limited thereto. In one or more embodiments the cross-sectional profile of the second shaft 3510 comprises an asymmetric shape, a symmetric shape, a polygonal shape, an oblong shape, a round shape with keyed recesses, a star shape, and/or shapes which restrict the angle 3551 of rotation of the grip 1050 in relation to the second axis. In one or more embodiments the cross-sectional shape of the second shaft 3510 allows for a plurality of angular configurations wherein the grip 1050 is interconnected with the second shaft 3510 at a first angle 3551 in a first configuration, and wherein the grip is interconnected with the second shaft 3510 at a second angle 3551, different from the first angle, in a second configuration. For instance, in the event the shaft 3510 comprises an octagonal cross-sectional shape, as illustrated in FIG. 16E, the grip 1050 is optionally interconnectable to the second shaft 3510 in eight different configurations, each with a different angle 3551 of rotation.

While various embodiments of the present disclosure have been described in detail, it is apparent that modifications and alterations of those embodiments will occur to those skilled in the art. However, it is to be expressly understood that such modifications and alterations are within the scope and spirit of the present disclosure. Further, the examples described herein are capable of other embodiments and of being practiced or of being carried out in various ways. In addition, it is to be understood that the phraseology and terminology used herein is for the purposes of description and should not be regarded as limiting. The use of "including," "comprising." or "adding" and variations thereof herein are meant to encompass the items listed thereafter and equivalents thereof, as well as, additional items.

What is claimed is:

1. An adjustable grip system for use with a trekking pole comprising:

a first portion having a first end configured to interconnect with a first shaft, and a second end of the first portion interconnected with a first end of a second portion, including a clevis configured to receive the second end of the first portion, at a joint, wherein the joint is configured to permit rotation of the second portion in relation to the first portion about a first axis, wherein the joint further comprises a first locking mechanism configured to constrain the rotation of the second portion in relation to the first portion when the first locking mechanism is engaged;

the second portion further comprises a second shaft comprising a second axis, different than the first axis, extending away from the joint;

the second shaft configured to have a grip interconnected thereto wherein the grip comprising a longitudinal recess configured to receive the second shaft slidably therein, wherein the grip is constrained to the second shaft with a fastener extending from an external aspect of the grip to interconnect with the second shaft, wherein the first locking mechanism comprises a keyed pin, and the clevis comprises a first keyed hole and a second keyed hole configured to receive the keyed pin therein, and the second end of the first portion comprises a third keyed hole configured to receive the keyed pin, wherein aligning the first keyed hole and the second keyed hole with the third keyed hole, and inserting the keyed pin therethrough, prevents the rotation of the second portion in relation to the first portion.

2. The adjustable grip system of claim 1, further comprising a first spring within a hollow aspect of the second shaft.

3. The adjustable grip system of claim 2, wherein interconnection of the fastener extending from an external aspect of the grip to interconnect with the second shaft engages the first spring.

4. The adjustable grip system of claim 3, further comprising second locking mechanism comprising a first keyed element interconnected to the second portion; and a second keyed element interconnected to the first end of the grip, wherein when the grip is pulled away from the second portion in a first direction coaxial with the second axis, the first spring is compressed, the second keyed element is disengaged from the first keyed element, and the grip is permitted to rotate about the second axis, and wherein when the grip is released, the first spring expands, pushing the second keyed element toward the first keyed element resulting in the second keyed element to engage with the first keyed element, and the grip is constrained from rotating about the second axis.

5. The adjustable grip system of claim 1, wherein the first locking mechanism comprises a first button on a first side of the joint, wherein the first button is coincident with the first axis, and wherein depressing the first button toward the joint unlocks the first locking mechanism thereby permitting the rotation of the second portion in relation to the first portion.

6. The adjustable grip system of claim 5, wherein the first locking mechanism further comprises a second spring configured to force the first button outward from the joint.

7. The adjustable grip system of claim 6, further comprising a second button axially opposite from the first button;

wherein depressing the buttons inward toward the joint, results in compressing the second spring, and unlocking the first locking mechanism, wherein the unlocking of the first locking mechanism permits the rotation of the second portion in relation to the first portion, and wherein releasing the buttons results in the second spring expanding, thereby pushing the buttons outward from the joint, and locking the first locking mechanism, wherein the locking of the first locking mechanism constrains the second portion from rotating in relation to the first portion.

8. The adjustable grip system of claim 1, wherein the fastener is coaxially aligned with the second axis.

9. The adjustable grip system of claim 8, wherein the second portion comprises a first lateral portion, and a second lateral portion, which are configured to interconnect via an interfacing surfaces to form the second portion.

10. The adjustable grip system of claim 9, wherein the interfacing surfaces are coplanar with the second axis.

11. The adjustable grip system of claim 8, wherein the second shaft comprises a keyed cross-sectional profile; and the grip comprises a hollow aspect configured to be coaxial with the second axis when the grip is interconnected with the second shaft, wherein the hollow aspect of the grip comprises a cross-sectional profile configured to receive the second shaft therein, and wherein the grip is constrained from rotating about the second axis when the grip is interconnected with the second shaft.

12. The adjustable grip system of claim 11, wherein the cross-sectional profile of the second shaft comprises a polygon.

13. The adjustable grip system of claim 11, wherein the grip is configured to be interconnected to the second shaft in a first configuration comprising a first angle of rotation around the second axis, and wherein the grip is configured to be interconnected to the second shaft in a second configuration comprising a second angle of rotation around the second axis, different than the first angle of rotation.

14. The adjustable grip system of claim 11, wherein the cross-sectional profile of the second shaft comprises symmetric polygon; and the cross-sectional profile of the longitudinal recess of the grip is configured to interconnect with the second shaft in a plurality of configurations, wherein the plurality of configurations comprise a plurality of angles of rotation around the second axis.

* * * * *